US012729927B2

(12) United States Patent
Butterfield

(10) Patent No.: US 12,729,927 B2
(45) Date of Patent: Sep. 8, 2026

(54) ARROW GUN HAVING A PLURALITY OF BARRELS FOR LAUNCHING A CORRESPONDING PLURALITY OF ARROWS

(71) Applicant: Crosman Corporation, Bloomfield, NY (US)

(72) Inventor: Ethan Thomas Butterfield, Ontario, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

(21) Appl. No.: 19/092,651

(22) Filed: Mar. 27, 2025

(65) Prior Publication Data

US 2025/0305790 A1 Oct. 2, 2025

Related U.S. Application Data

(60) Provisional application No. 63/571,137, filed on Mar. 28, 2024.

(51) Int. Cl.

| | |
|---|---|
| ***F41B 11/62*** | (2013.01) |
| ***F41B 11/723*** | (2013.01) |
| ***F42B 6/02*** | (2006.01) |

(52) U.S. Cl.
CPC ..... *F41B 11/62* (2013.01); *F41B 11/723* (2013.01); *F42B 6/02* (2013.01)

(58) Field of Classification Search
CPC ..... F41B 11/00; F41B 11/62; F41B 11/723; F41B 11/83; F42B 6/02; F42B 6/00
See application file for complete search history.

(56) References Cited

U.S. PATENT DOCUMENTS

| | | | | |
|---|---|---|---|---|
| 2,736,308 | A | 2/1956 | Vilarrubis et al. | |
| 2,833,266 | A | 5/1958 | Lodovico | |
| 2,839,862 | A | 6/1958 | Hanshaw | |
| 2,861,560 | A | 11/1958 | Carlo | |
| 2,900,972 | A | 8/1959 | March et al. | |
| 2,923,286 | A | 2/1960 | Degrante | |
| 2,964,031 | A | 12/1960 | Dotson | |
| 3,045,659 | A | 7/1962 | Malcom | |
| 3,071,883 | A | 1/1963 | Merz | |
| 3,320,941 | A | 5/1967 | Houghton | |
| 3,717,947 | A | 2/1973 | Nomura et al. | |
| 3,741,190 | A * | 6/1973 | Lopez | F41B 7/04 124/31 |

(Continued)

FOREIGN PATENT DOCUMENTS

| | | |
|---|---|---|
| EP | 2336707 A1 | 6/2011 |
| EP | 3058307 B1 | 3/2019 |

(Continued)

*Primary Examiner* — Benjamin P Lee
(74) *Attorney, Agent, or Firm* — Douglas R. Smith; Harter Secrest & Emery LLP

(57) ABSTRACT

An arrow gun is provided having a plurality of barrels, wherein a flow path for pressurized gas includes a unique portion to at least two of the barrels. Upon a mass of regulated pressure gas passes from an upstream firing valve in the flow path, the respective flow paths are configured such that the mass of regulated pressure gas creates a launching pressure at different times between the two barrels, thereby imparting a sequential launch of the respective arrows.

17 Claims, 18 Drawing Sheets

(56) References Cited

U.S. PATENT DOCUMENTS

| | | | | |
|---|---|---|---|---|
| 4,660,315 | A | 4/1987 | Ferro | |
| 4,890,597 | A | 1/1990 | Ekstrom | |
| 5,086,749 | A | 2/1992 | Ekstrom | |
| 5,161,516 | A | 11/1992 | Ekstrom | |
| 5,343,850 | A | 9/1994 | Steer | |
| 5,896,849 | A | 4/1999 | Branthwaite et al. | |
| RE38,096 | E | 4/2003 | Branthwaite et al. | |
| 6,708,683 | B1 * | 3/2004 | Harris | F41B 7/04 124/20.3 |
| 6,811,503 | B2 * | 11/2004 | May | F41B 7/04 473/578 |
| 7,146,973 | B2 | 12/2006 | Seekman et al. | |
| 7,412,975 | B2 | 8/2008 | Dillon, Jr. | |
| 7,984,708 | B2 | 7/2011 | Pedicini et al. | |
| 8,087,406 | B2 * | 1/2012 | Axelsson | F41B 11/62 124/71 |
| 8,210,161 | B2 | 7/2012 | Mattos | |
| 8,567,378 | B2 * | 10/2013 | Nugent | F41B 11/642 124/59 |
| 9,086,251 | B2 | 7/2015 | Cummings | |
| 9,103,623 | B2 | 8/2015 | Gianelli et al. | |
| 9,506,717 | B2 * | 11/2016 | Jaber | F41C 9/06 |
| 9,546,844 | B2 | 1/2017 | Hall et al. | |
| 9,719,752 | B1 | 8/2017 | Nibecker, Jr. | |
| 9,851,173 | B2 | 12/2017 | Malheiros et al. | |
| 9,933,231 | B2 | 4/2018 | Malheiros et al. | |
| 10,408,564 | B2 | 9/2019 | Malheiros et al. | |
| 10,845,155 | B2 | 11/2020 | Malheiros et al. | |
| 10,955,215 | B2 | 3/2021 | Witzigreuter et al. | |
| 11,243,045 | B2 | 2/2022 | Witzigreuter | |
| 11,378,353 | B2 | 7/2022 | Malheiros et al. | |
| 11,988,482 | B2 * | 5/2024 | Chen | F41B 11/83 |
| 2004/0069291 | A1 * | 4/2004 | May | F41B 11/83 124/17 |
| 2004/0173197 | A1 * | 9/2004 | Moffitt | F41B 11/83 124/74 |
| 2005/0066951 | A1 | 3/2005 | Seekman et al. | |
| 2005/0188979 | A1 | 9/2005 | Berry | |
| 2006/0254570 | A1 | 11/2006 | Dillon, Jr. | |
| 2009/0056693 | A1 | 3/2009 | Pedicini et al. | |
| 2009/0159065 | A1 * | 6/2009 | Moffitt | A01K 81/00 124/71 |
| 2010/0288256 | A1 | 11/2010 | Mattos | |
| 2011/0146646 | A1 * | 6/2011 | Axelsson | F41B 11/62 124/71 |
| 2013/0239938 | A1 * | 9/2013 | Nugent | F41B 11/55 124/59 |
| 2014/0251296 | A1 | 9/2014 | Flint et al. | |
| 2015/0101584 | A1 | 4/2015 | Cummings | |
| 2015/0198407 | A1 | 7/2015 | Giannelli et al. | |
| 2016/0033231 | A1 | 2/2016 | Hall et al. | |
| 2016/0187097 | A1 * | 6/2016 | Jaber | F41B 7/04 124/83 |
| 2017/0016694 | A1 | 1/2017 | Malheiros et al. | |
| 2017/0131060 | A1 | 5/2017 | Malheiros et al. | |
| 2018/0283824 | A1 | 10/2018 | Malheiros et al. | |
| 2019/0390934 | A1 | 12/2019 | Malheiros et al. | |
| 2020/0378716 | A1 | 12/2020 | Flint | |
| 2021/0055074 | A1 | 2/2021 | Witzigreuter et al. | |
| 2021/0140737 | A1 | 5/2021 | Malheiros et al. | |
| 2021/0381798 | A1 | 12/2021 | Witzigreuter | |
| 2022/0178645 | A1 | 6/2022 | Kenworthy | |
| 2022/0307793 | A1 * | 9/2022 | Malheiros | F41B 11/723 |
| 2024/0118052 | A1 * | 4/2024 | Chen | F41B 11/73 |

FOREIGN PATENT DOCUMENTS

| | | | |
|---|---|---|---|
| WO | 2004076957 | A1 | 12/2003 |
| WO | 2005069929 | A2 | 8/2005 |
| WO | 2015057590 | A1 | 4/2015 |
| WO | 2019196961 | A1 | 10/2019 |
| WO | 2021034760 | A1 | 8/2020 |

* cited by examiner

ARROW GUN HAVING A PLURALITY OF BARRELS FOR LAUNCHING A CORRESPONDING PLURALITY OF ARROWS

CROSS-REFERENCE TO RELATED APPLICATIONS

The present application claims the benefit of U.S. provisional patent application 63/571,137 filed Mar. 28, 2024, entitled ARROW GUN HAVING A PLURALITY OF BARRELS FOR LAUNCHING A CORRESPONDING PLURALITY OF ARROWS, the entire disclosure of which is hereby incorporated by reference.

STATEMENT REGARDING FEDERALLY SPONSORED RESEARCH OR DEVELOPMENT

Not applicable.

REFERENCE TO A "SEQUENCE LISTING"

Not applicable.

BACKGROUND

Field of the Invention

The present disclosure relates to arrow guns and particularly to arrow guns using compressed gas to propel an arrow, and more particularly to an arrow gun having a plurality of barrels, wherein each barrel is connected to a corresponding unique flow path configured to provide that an exposure of the flow paths to a common upstream mass of high pressure gas, results in the barrels receiving a launching pressure of the high pressure gas at different times.

Description of Related Art

Compressed gas has been used to propel BBs from a gun for many years. However, the ability to propel an arrow, such as a standard length arrow from a gun by compressed gas has not been well developed. Thus, there exists a need for an improved compressed gas gun capable of launching an arrow.

The need also exists for a compressed gas gun able to exert a launching pressure at a plurality of barrels and hence corresponding arrows to impart a sequential launch of the arrows in response to a common mass of upstream pressurized gas.

BRIEF SUMMARY OF THE INVENTION

Propelling an arrow is complicated because the compressed gas must expand and travel through the barrel to contact the arrow, thus a gradually increasing pressure front is exerted upon the arrow. This gradually increasing pressure front reaches a launching pressure and causes the arrow to begin moving from the barrel before the maximum pressure exertable by the compressed gas has a chance to act upon the arrow.

The present disclosure provides a method of launching a first arrow having a first hollow portion and a second arrow having a second hollow portion, the method including concurrently exposing the first hollow portion and the second hollow portion to a pressurized gas through a first flow path fluidly connected to the first hollow portion and a second flow path fluidly connected to the second hollow portion.

A further method is provided including the method of launching a first a first arrow having a first hollow portion and a second arrow having a second hollow portion, the method including releasing, though a valve, a mass of compressed gas from a high pressure reservoir; passing a first portion of the released mass of compressed gas through a first flow path to a first barrel; and passing, during the passing the first portion of the released mass of compressed gas, a second portion of the released mass of compressed gas through a second flow path to a second barrel.

The present disclosure provides an arrow gun using compressed gas to propel a first arrow having a first hollow portion and a second arrow having a second hollow portion, the arrow gun including a high pressure reservoir; a barrel manifold having an inlet, a first outlet, and a second outlet, the barrel manifold including a first manifold passageway from the inlet to the first outlet and a second manifold passageway from the inlet to the second outlet; a flow path fluidly connecting the high pressure reservoir and the inlet of the barrel manifold; a valve in the flow path intermediate the high pressure reservoir and the inlet of the barrel manifold; an elongate first barrel connected to the first outlet of the barrel manifold and extending along a first longitudinal axis to terminate a first free end, the first barrel having an outer diameter sized to be slidably received within the first hollow portion of the first arrow; and an elongate second barrel connected to the second outlet and extending along a second longitudinal axis to terminate a second free end, the second barrel having an outer diameter sized to be slidably received within the second hollow portion of the second arrow.

Also disclosed is an arrow gun using compressed gas to propel a first arrow having a first hollow portion and a second arrow having a second hollow portion, the arrow gun including a high pressure reservoir configured to retain a mass of pressurized gas; a valve having an inlet and an outlet, the inlet fluidly connected to the high pressure reservoir and the configured to selectively pass the pressurized gas to the outlet; a first flow path fluidly connecting the high pressure reservoir and the inlet of the valve; an elongate first barrel extending along a first longitudinal axis to terminate a first free end, the first barrel having an outer diameter sized to be slidably received within the first hollow portion of the first arrow; a second flow path fluidly connecting the outlet of the valve and the first barrel; an elongate second barrel connected to the second outlet and extending along a second longitudinal axis to terminate a second free end, the second barrel having an outer diameter sized to be slidably received within the second hollow portion of the second arrow; and a third flow path fluidly connecting the outlet of the valve and the second barrel.

The present disclosure also includes an arrow gun using compressed gas to propel a first arrow having a first hollow portion and a second arrow having a second hollow portion, the arrow gun having a high pressure reservoir configured to retain a mass of pressurized gas; an elongate first barrel extending along a first longitudinal axis to terminate a first free end, the first barrel having an outer diameter sized to be slidably received within the first hollow portion of the first arrow; a first flow path fluidly connecting the high pressure reservoir and the first barrel; an elongate second barrel connected to the second outlet and extending along a second longitudinal axis to terminate a second free end, the second barrel having an outer diameter sized to be slidably received within the second hollow portion of the second arrow; and a second flow path fluidly connecting the high pressure reservoir and the second barrel, wherein the first flow path and the second flow path are configured to expose the first barrel and the second barrel to a launch pressure at different times in response to a release of a portion of the mass of pressurized gas from the high pressure reservoir.

Also disclosed is an arrow gun using compressed gas to propel a first arrow having a first hollow portion and a second arrow having a second hollow portion, the arrow gun including a barrel manifold having an inlet, a first outlet and a second outlet; a first barrel connected to the first outlet; a second barrel connected to the second outlet; and a high pressure reservoir connected to the inlet of the barrel manifold.

BRIEF DESCRIPTION OF THE SEVERAL VIEWS OF THE DRAWING(S)

Figure 18:
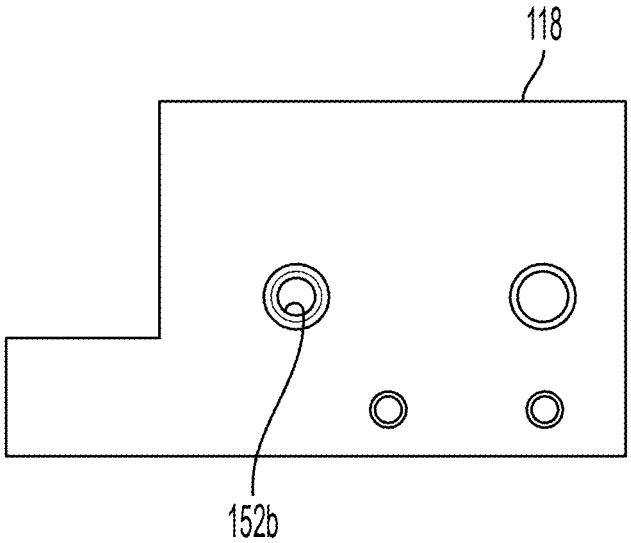

FIG. 18 a side elevational view of the barrel manifold.

Figure 19:
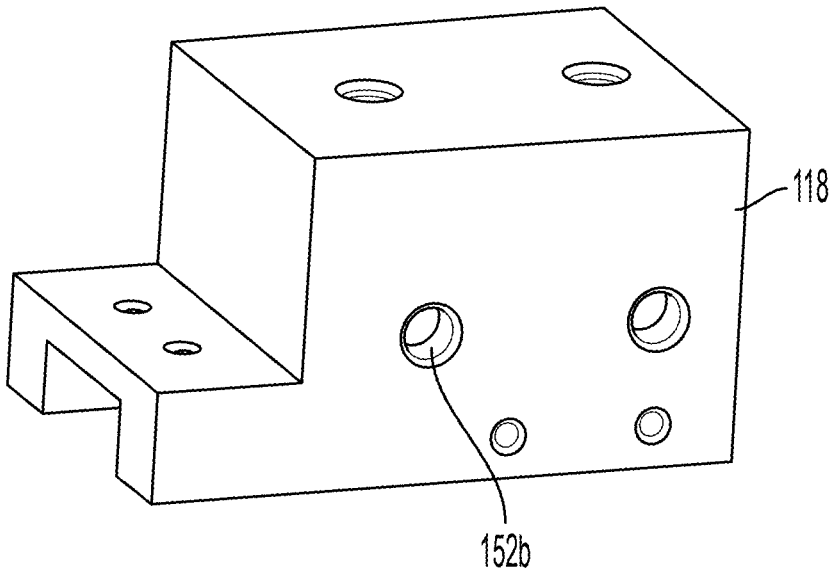

FIG. 19 is a side perspective view of the barrel manifold.

Figure 20:
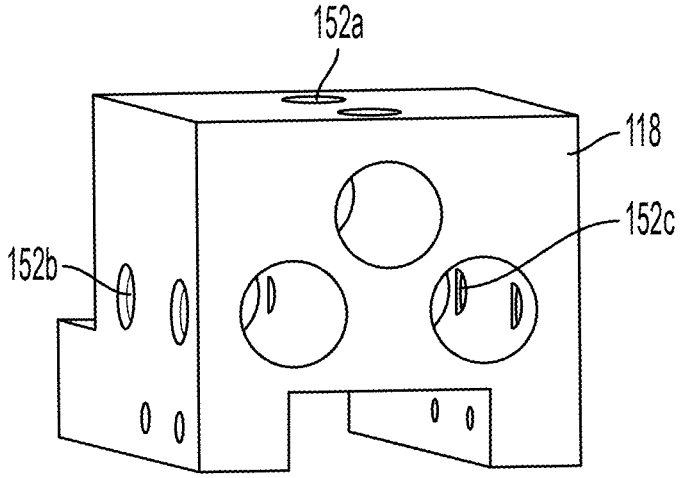

FIG. 20 is a side perspective view of the barrel manifold.

Figure 21:
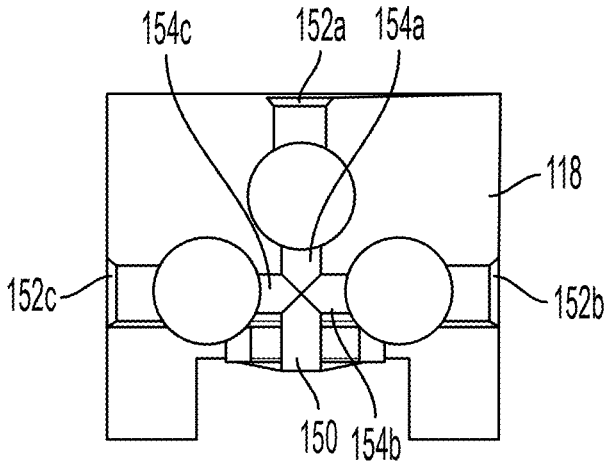

FIG. 21 is a cross sectional view of the barrel manifold.

Figure 22:
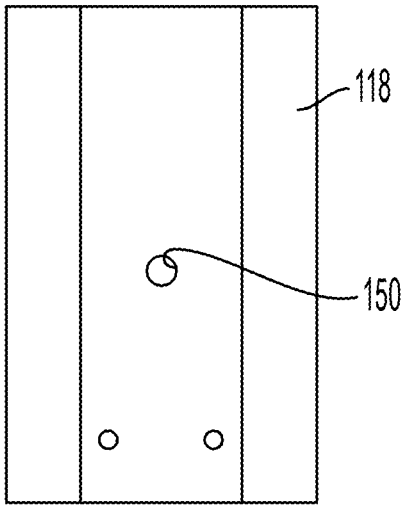

FIG. 22 is a bottom plan view of the barrel manifold.

Figure 23:
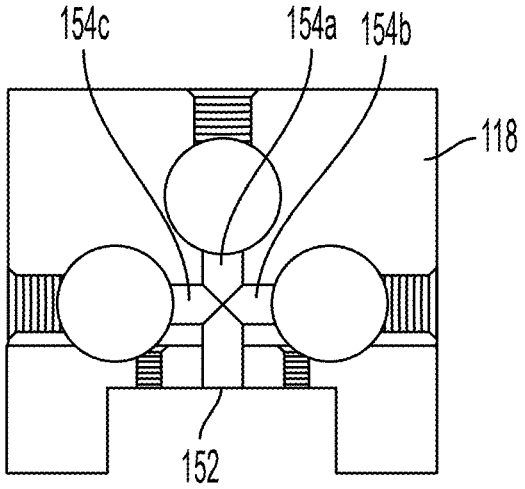

FIG. 23 is a cross sectional view of the barrel manifold.

Figure 24:
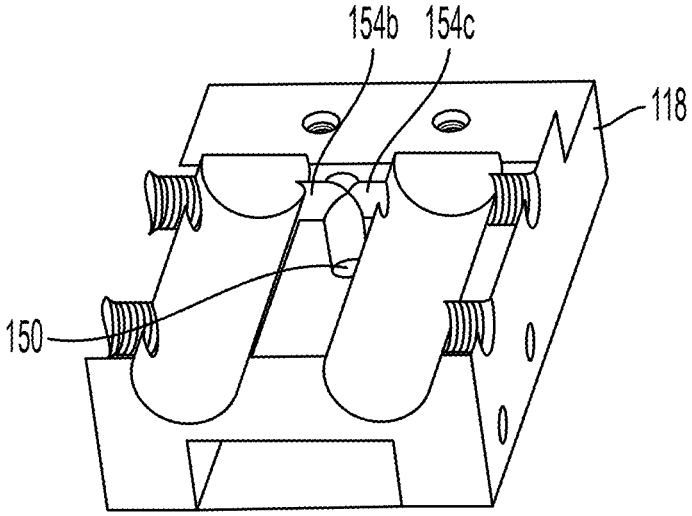

FIG. 24 is a bottom perspective view of a portion of the barrel manifold.

Figure 25:
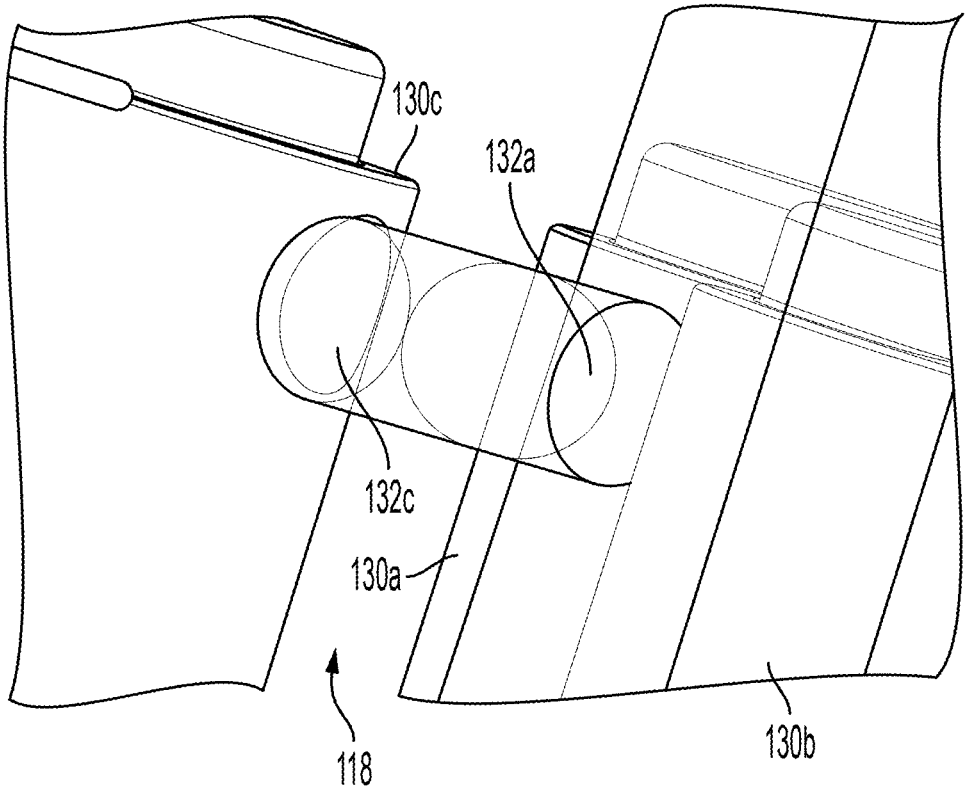

FIG. 25 is an enlarged perspective of the barrel manifold in phantom with the flow path.

Figure 26:
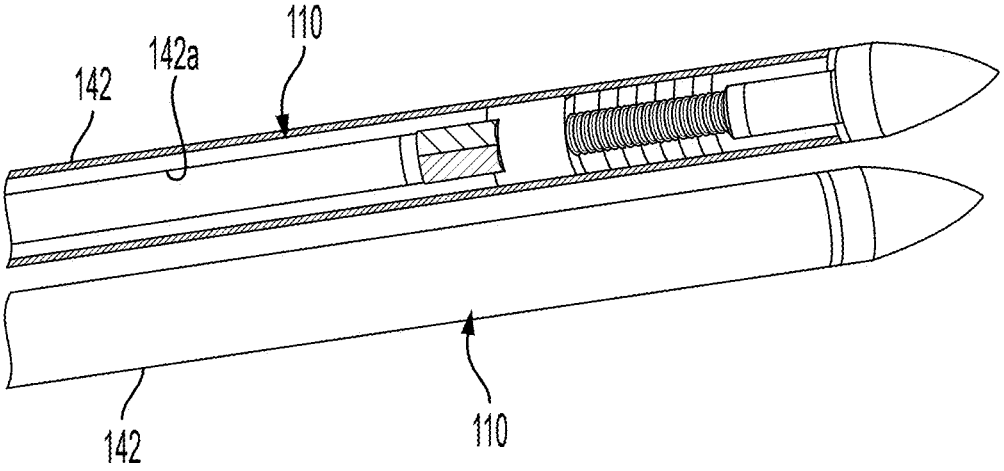

FIG. 26 is a perspective view of a portion of an arrow for the arrow gun.

Figure 27:
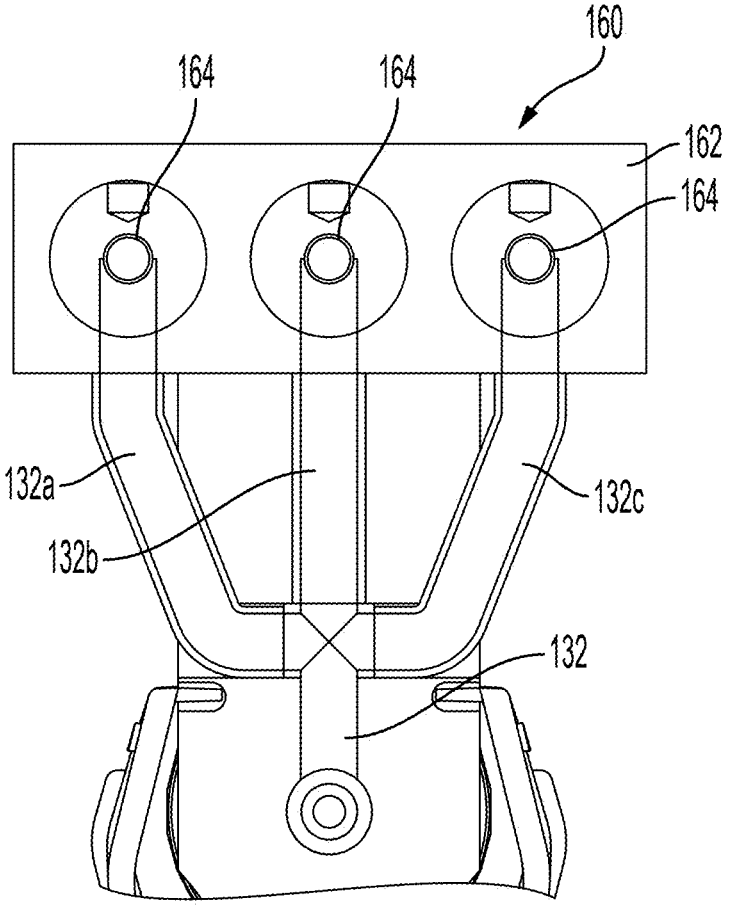

FIG. 27 is a front cross sectional view of an embodiment employing air tubes to a barrel block.

Figure 28:
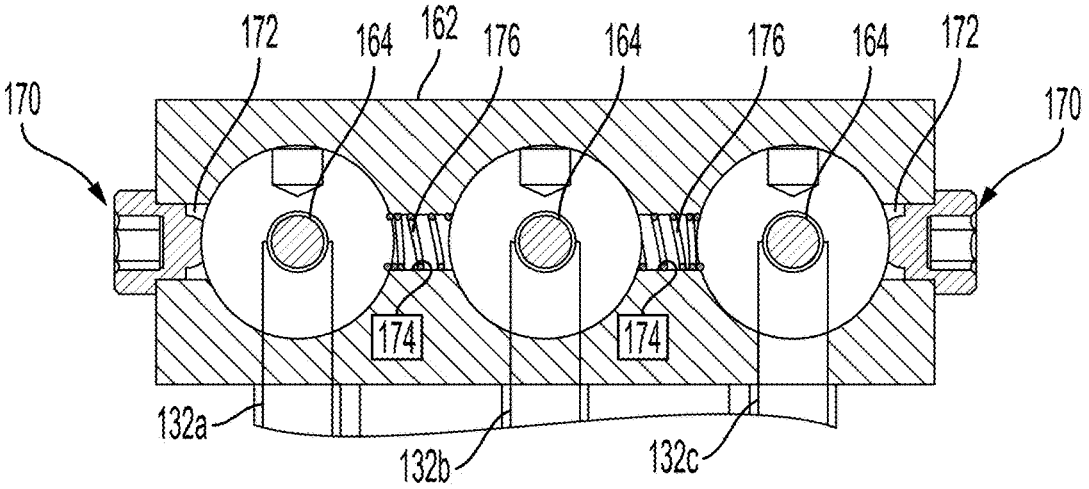

FIG. 28 a front cross sectional view of an embodiment employing a barrel block with adjustable alignment of the barrels.

Figure 29:
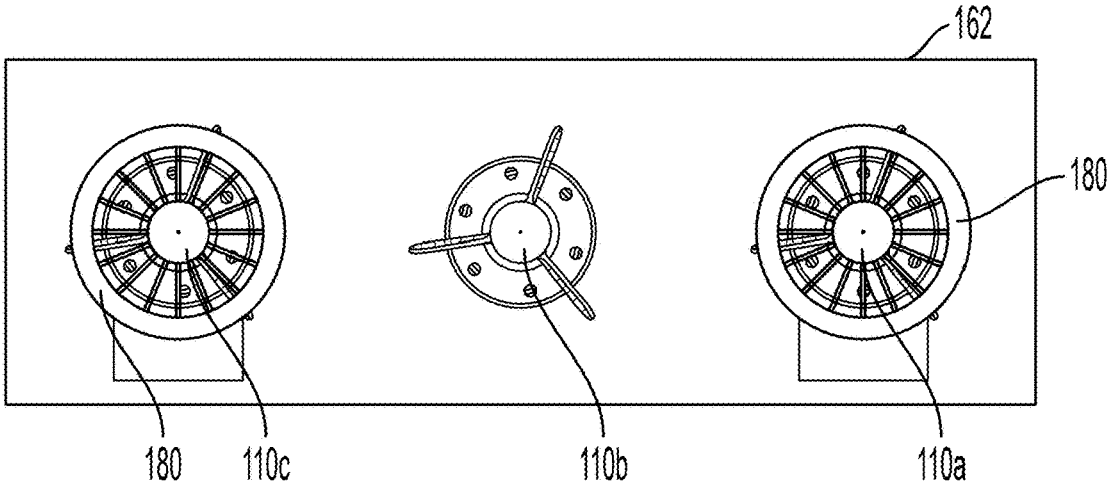

FIG. 29 is a front elevational view of a barrel block with an arrow on each barrel and a "whisker biscuit" aligned with two barrels, wherein the three barrels are parallel.

Figure 30:
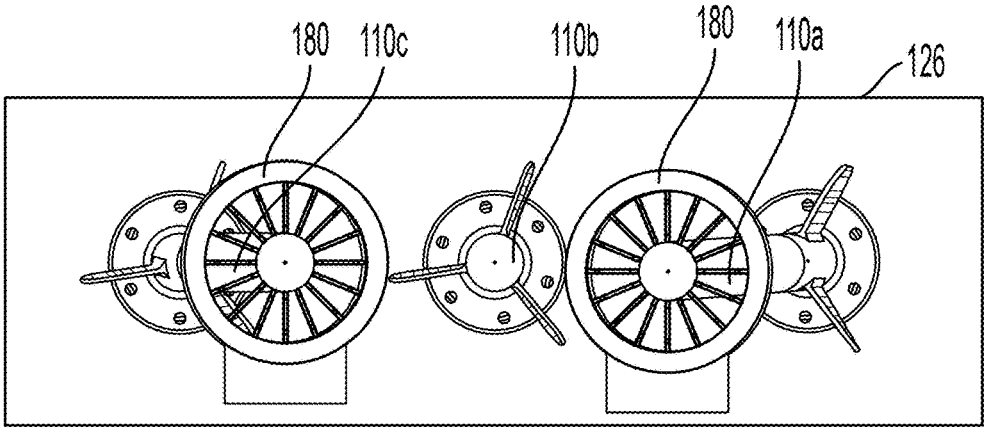

FIG. 30 is a front elevational view of a barrel block with an arrow on each barrel and an arrow rest aligned with two barrels, wherein a longitudinal axis of each of the three barrels intersect.

Figure 31:
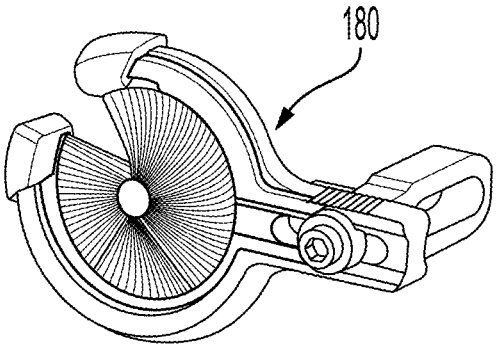

FIG. 31 is a perspective view of a representative arrow rest.

Figure 32:
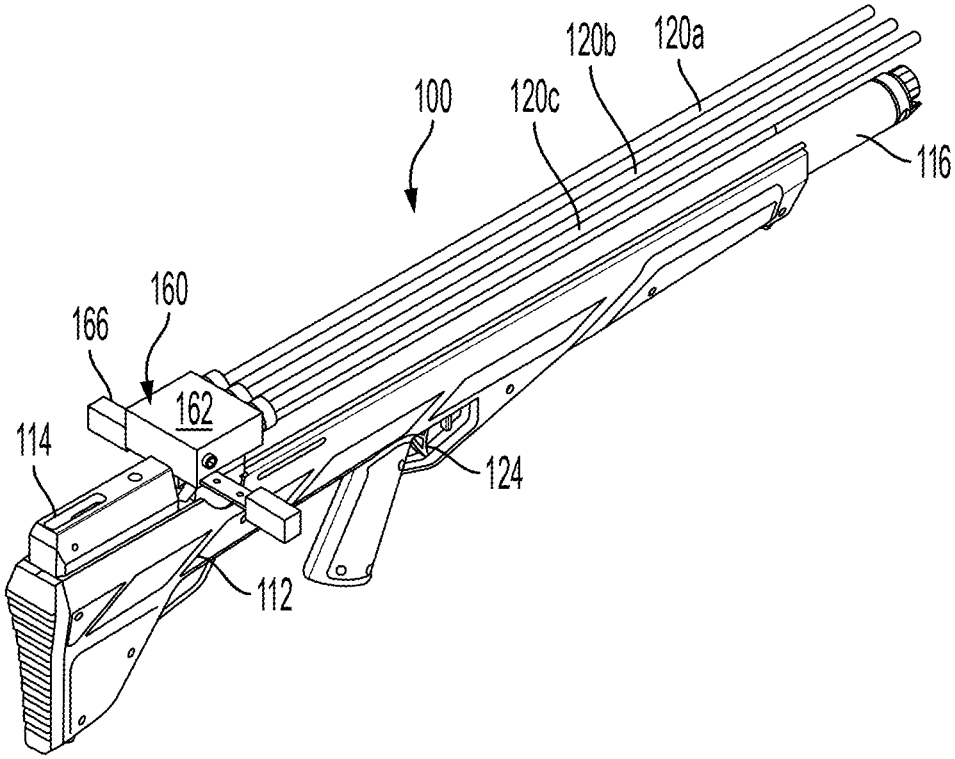

FIG. 32 is a perspective view of a further configuration of the arrow gun having a throttle for selectively restricting gas flow to selective barrels.

Figure 33:
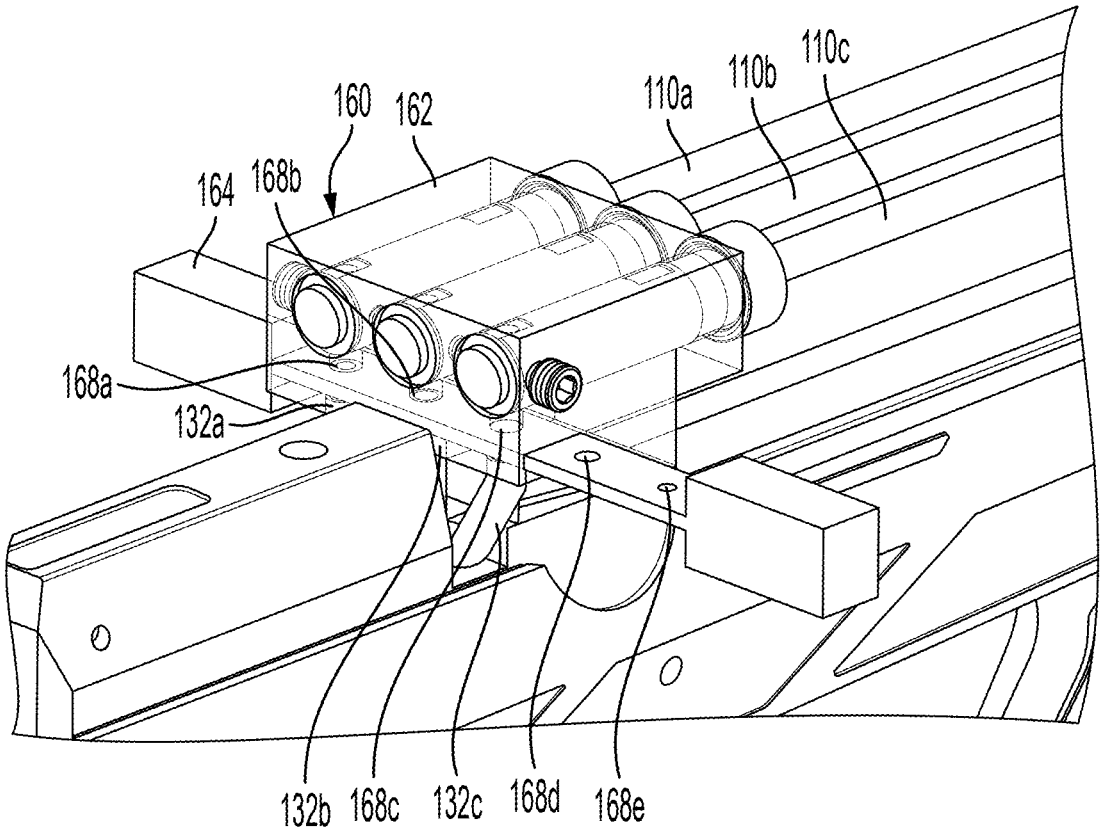

FIG. 33 is a perspective view of the throttle of FIG. 32 with portions shown as transparent and the throttle in a first position.

Figure 34:
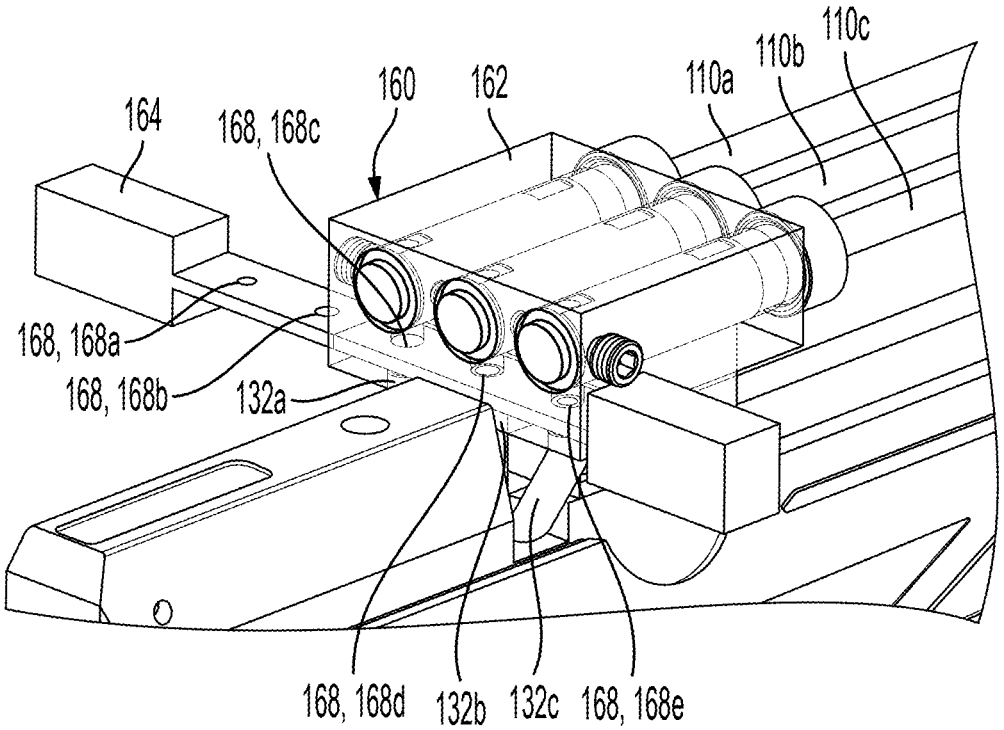

FIG. 34 is a perspective view of the throttle of FIG. 32 with portions shown as transparent and the throttle in a second position.

Figure 35:
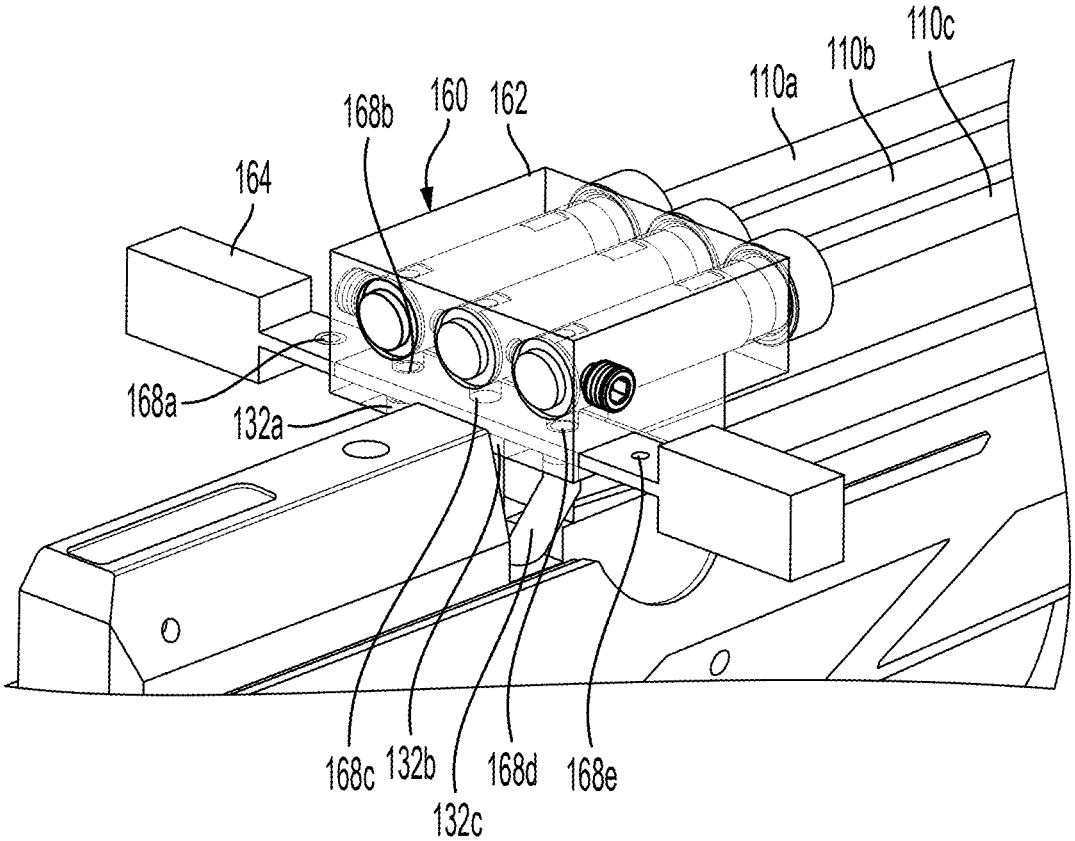

FIG. 35 is a perspective view of the throttle of FIG. 32 with portions shown as transparent and the throttle in a third position.

DETAILED DESCRIPTION OF THE INVENTION

Figure 1:
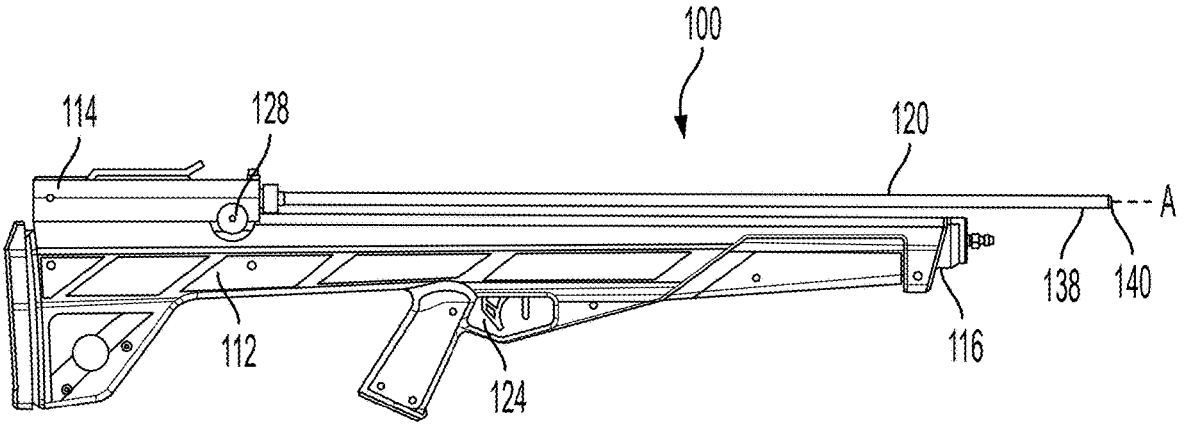
FIG. 1 is a perspective view of a portion of a representative arrow gun.
Figure 2:
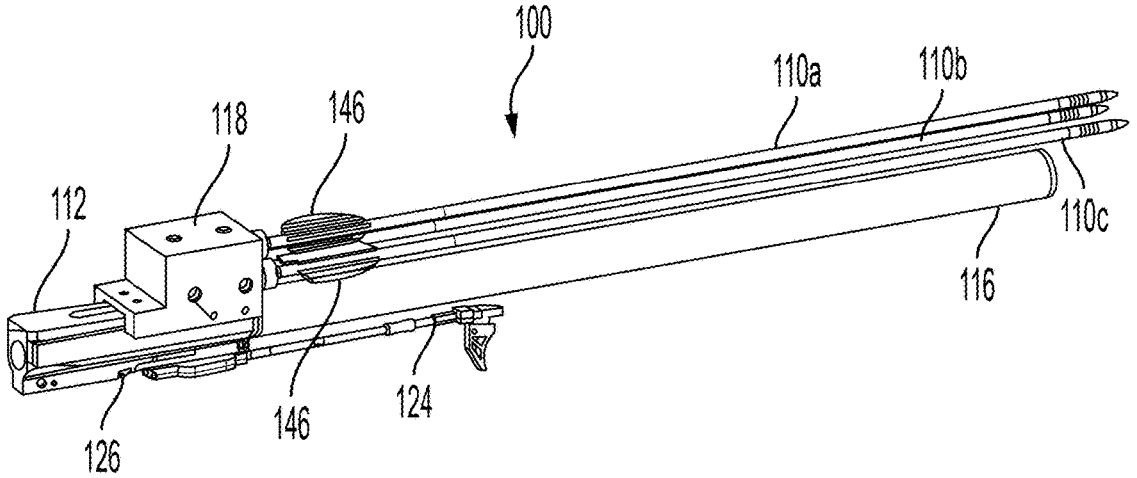
FIG. 2 is a perspective view of a portion of the present arrow gun showing three arrows engaged with three corresponding barrels of the arrow gun.

Referring to FIGS. 1 and 2, a representative pneumatic, or compressed gas gun 100 for propelling an arrow 110, an arrow gun, is shown.

In one configuration, as seen in FIGS. 1 and 2, the arrow gun 100 includes a stock 112, a receiver 114, a high pressure reservoir 116, a barrel manifold 118, and at least a first barrel 120*a* and a second barrel 120*b* (collectively or individually, a barrel 120).

The stock 112 can include or retain the high pressure reservoir 116 of compressed gas, as well as a trigger assembly 124 and a gas valving system 126 as known in the art. Representative reservoirs, trigger assemblies, and gas valving systems can operably retain compressed gas at a pressure of 2,000 psi to 7,000 psi, wherein the valving system presents the gas to the receiver and hence the barrel at approximately 500 psi to 5,000 psi. In one configuration, the gas valving system includes a regulator 128, such as a pressure regulator, for regulating the pressure of the compressed gas from the high pressure reservoir to a firing valve, wherein the firing valve then selectively passes the regulated compressed gas to be exposed to the arrows, via the barrels.

The receiver 116 cooperatively connects each barrel 120, e.g. barrels 120*a*, 120*b* to the stock 112. As seen in FIGS. 5-13, the receiver 114 includes a barrel adapter 130. The barrel adapter 130 can be integral with the receiver 114 or a component of the receiver 114. As used herein, the term receiver is taken to include the barrel adapter. Thus, barrel adapter 130 can be understood to be the receiver 114. As set forth in U.S. Pat. No. 10,845,155, herein expressly incorporated by reference, the barrel adapter 130 includes at least one barrel receiving recess 134.

In one configuration, the barrel adapter 130 is as set forth in U.S. Pat. No. 11,378,353, herein expressly incorporated by reference. It is further contemplated the barrel 120 can be connected to the receiver 114 by any of a variety of mechanism, including but not limited to fastening, bonding, welding, or threading.

The barrel 120 is elongate and sized to be slidably received within the arrow 110. In one configuration, the barrel 120 extends along a longitudinal axis A and has a diameter $D_B$ of approximately 0.25 to 0.5 inches. While a wall thickness of the barrel 120 can be partly determined by desired operating characteristics, a satisfactory barrel wall thickness has been found to include approximately 0.020 inches. The barrel 120 can be formed of a variety of materials including, but not limited to composites, laminates, plastics including elastomers, and metal. A satisfactory material for the barrel 120 includes stainless steel or carbon fiber.

In one configuration, as seen in FIGS. 10-13, the barrel 120 includes a threaded outer surface 136*a* adjacent one end 136 of the barrel 120. The wall thickness of the barrel 120 is partly selected to accommodate the external threads 136*a* for engaging the barrel adapter 130, also referred to as a barrel block 130. The remaining end 138 of the barrel defines a muzzle 140 at a free end of the barrel 120.

The barrel 120 extends from the receiver 114, such as from the barrel adapter/the barrel block 130, to extend a free length of approximately 12 inches to 36 inches. That is, the barrel 120 is unsupported for a length of approximately 12 inches to 36 inches. In certain configurations, the barrel length is between approximately 20 inches to 31 inches with one configuration having a barrel length of approximately 26 inches.

In one configuration, at least a portion 142*a* of the shaft 142 of the arrow 110 is hollow and sized to slidably receive the barrel 120 therein. As set forth below, for a barrel 120 having an outer diameter $D_B$ of approximately 0.354", the inner diameter $D_S$ of the hollow shaft 142*a* is approximately 0.314". The shaft 142 thus has an open end 142' at a rear end of the arrow 110. The hollow length of the arrow 110 can be from approximately 25% to 95% of the overall length of the arrow 110.

The term arrow includes an elongate shaft having an arrowhead such as a pointed or penetrating end. The arrow typically includes fletching adjacent a rear end of the arrow; however, it is understood the fletching is not required.

The arrow 110 can have a variety of lengths from approximately 12 inches to approximately 36 inches. Depending on the construction of the arrow, the arrow 110 can have a weight from approximately 250 to approximately 450 grains.

It is further contemplated the arrow 110 can include reinforcing ribs or strands 144 configured to increase the pressure that the hollow portion 142*a* can withstand. In one configuration, the reinforcing ribs 144 extend along all or a portion of an outside surface of the hollow portion 142*a* of the arrow 110. In a further configuration, the reinforcing strands 144 are a high tensile material embedded into the material of the hollow portion 142*a* of the arrow 110 to impart increased resistance to compressed gas when inside the hollow portion.

While the description is set forth in terms of the arrow 110 that fits over a fixed tube barrel 120, wherein the barrel 120 fills with high-pressure gas and the high pressure gas acts on an inside of a tip of the arrow 110 to propel the arrow forward, it is understood the present system can be employed with air bolts which include a plug end, typically having a sealing interface as well as a nock at the back that slides into the barrel of an airgun and locks it into place ready to fire, wherein the compressed air acts on a rear surface of the plug end. As in the first configuration, the present description is set forth with the barrel as an elongate tube, wherein in a further configuration rather than the arrow fitting over the barrel, the arrow fits within the barrel.

Figure 3:
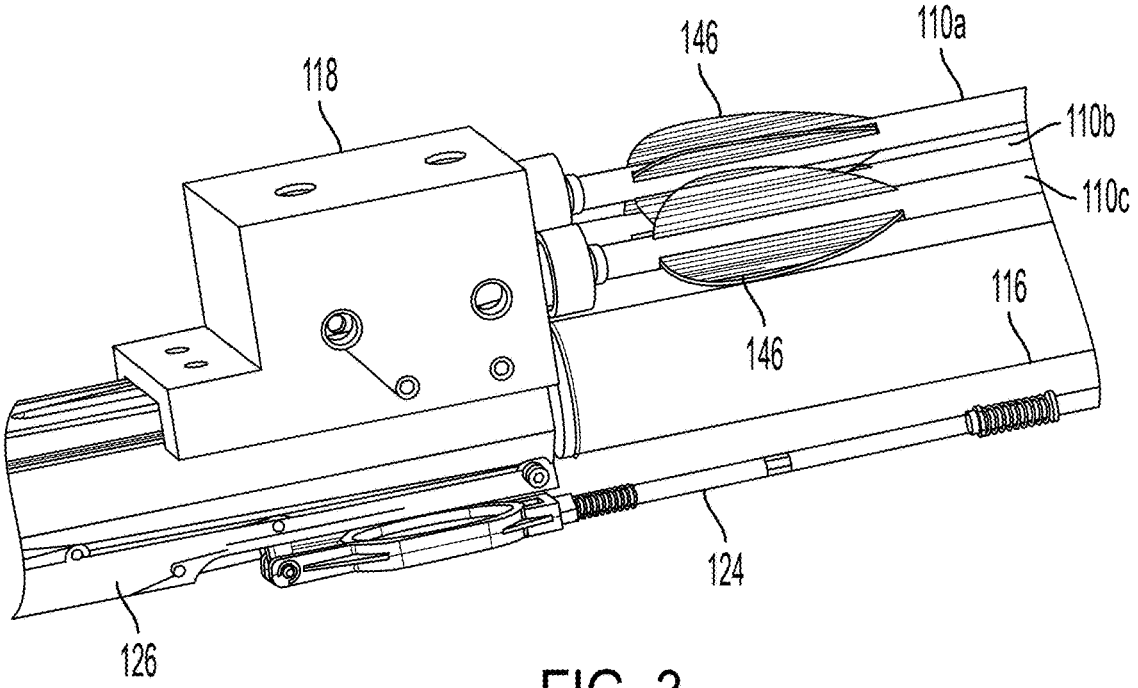
FIG. 3 is an enlarged perspective view of a portion of the arrow gun of FIG. 2.
Figure 4:
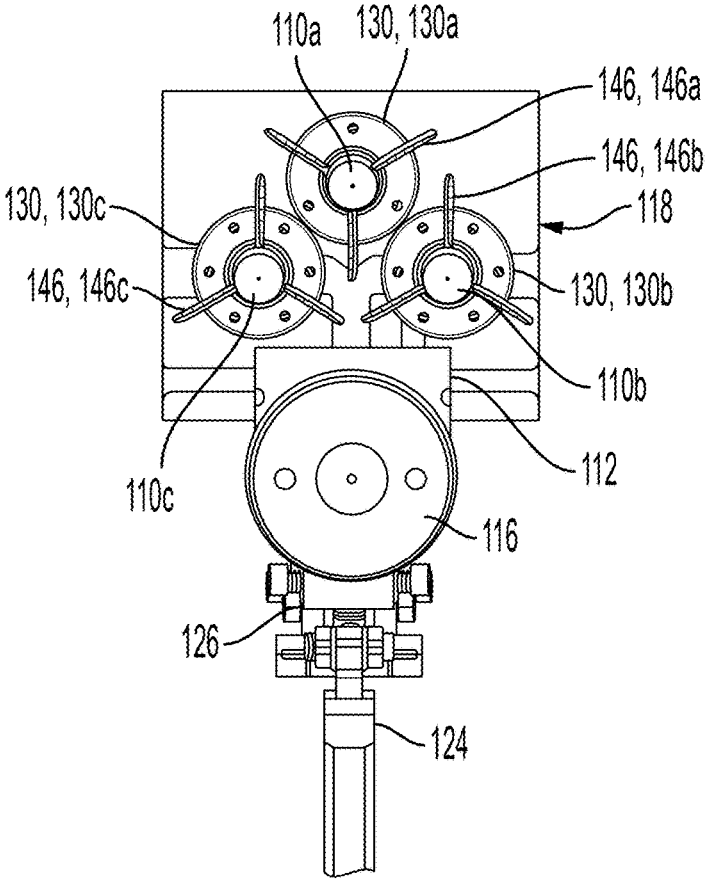
FIG. 4 is a front elevational view of the arrow gun of FIG. 3.
Figure 5:
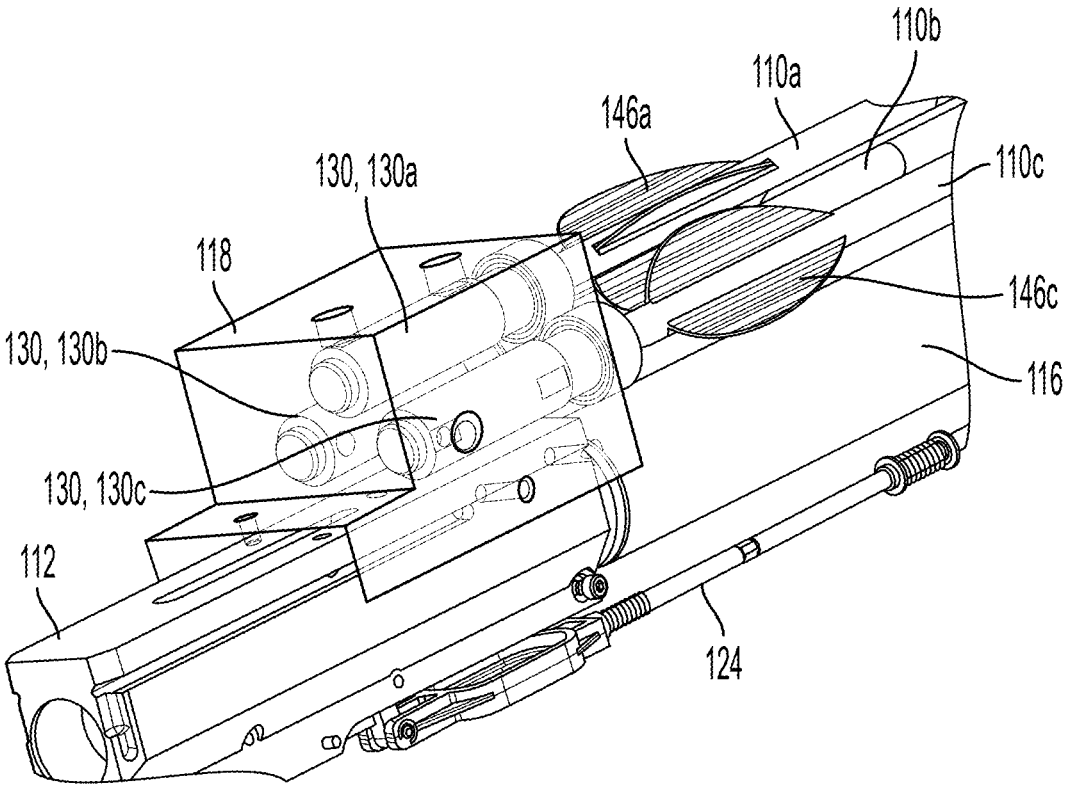
FIG. 5 is a perspective view of the arrow gun of FIG. 2 with the barrel manifold in phantom showing the barrel adapters.
Figure 6:
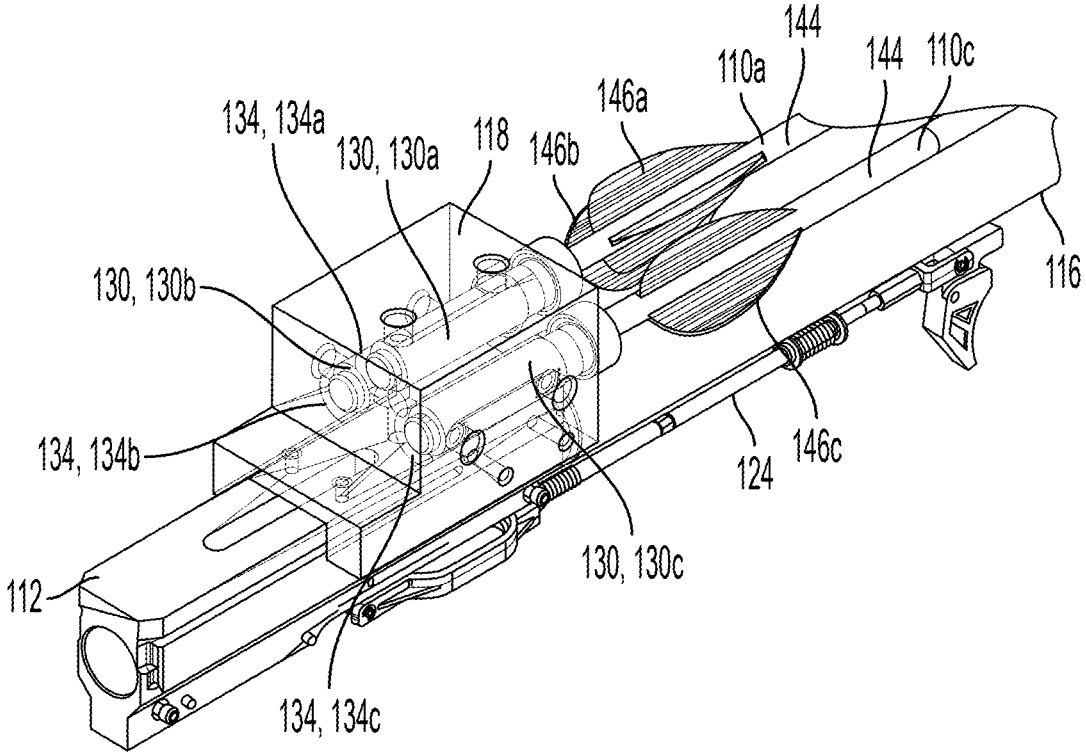
FIG. 6 is a perspective view of the arrow gun of FIG. 2 with the barrel manifold in phantom showing the barrel adapters.
Figure 7:
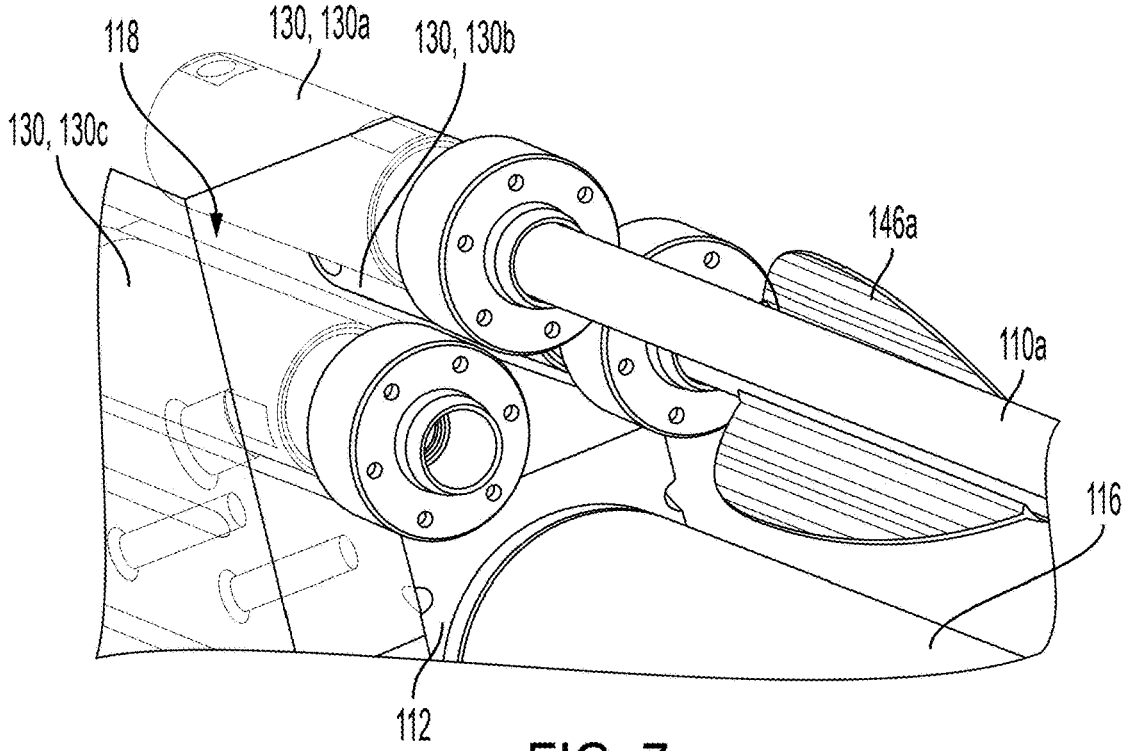
FIG. 7 is an enlarged front perspective view of the arrow gun of FIG. 2 with the barrel manifold in phantom showing the barrel adapters.
Figure 8:
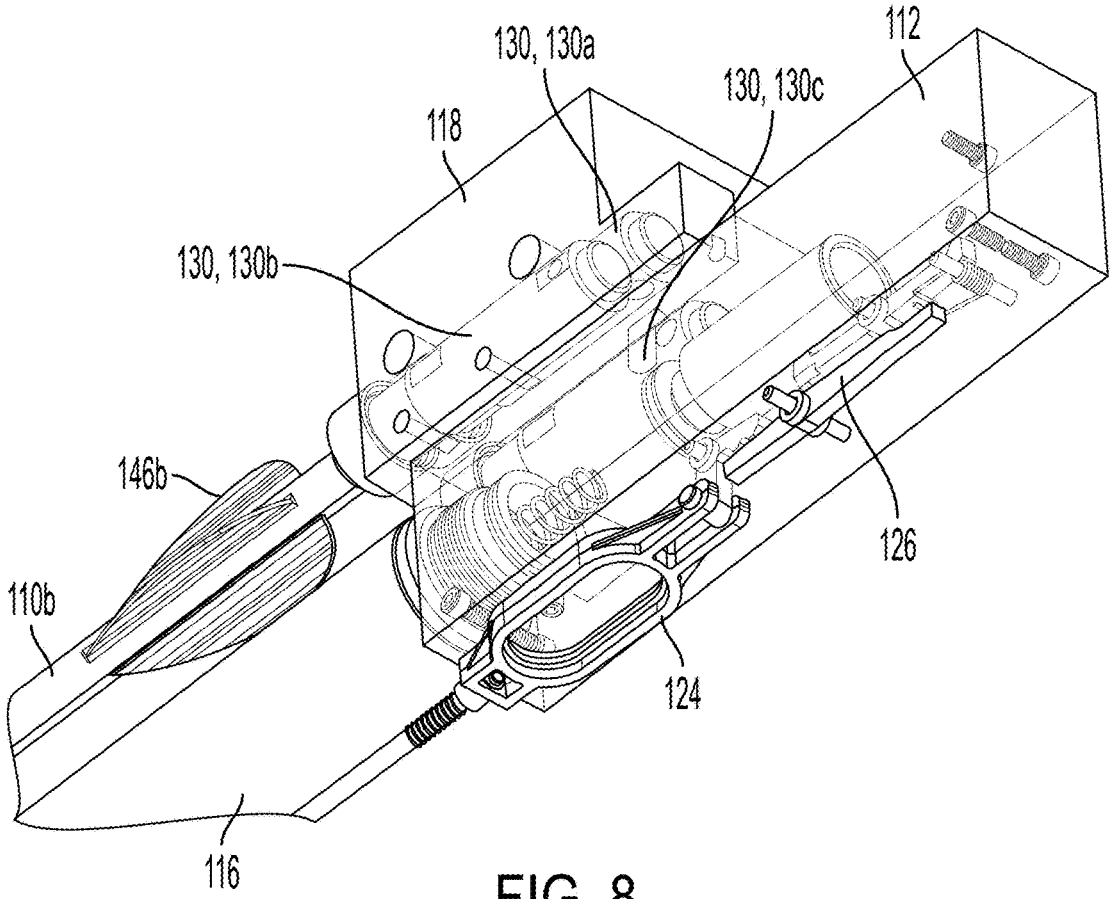
FIG. 8 is a bottom perspective view of the arrow gun of FIG. 2 with the barrel manifold in phantom showing the barrel adapters.
Figure 9:
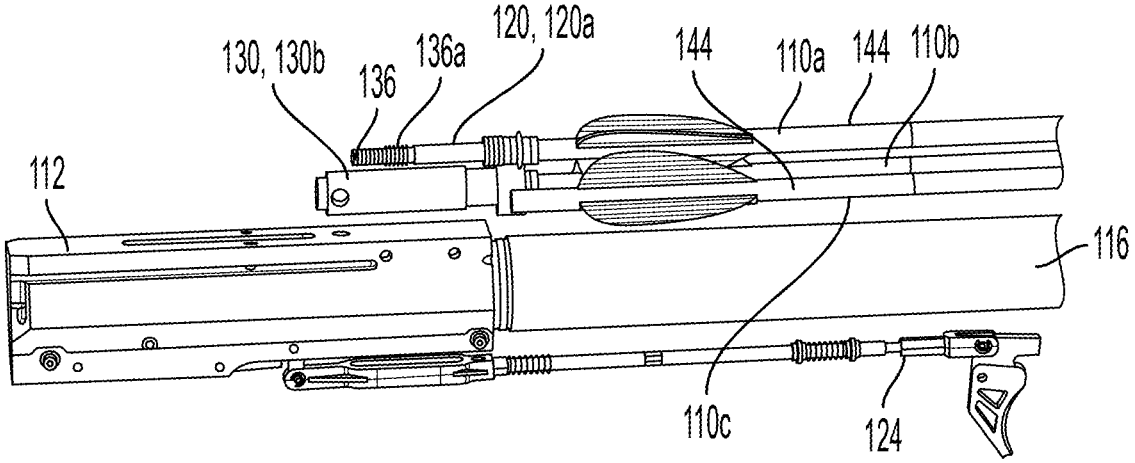
FIG. 9 is a bottom perspective view of the arrow gun of FIG. 2 with the barrel manifold in phantom showing the barrel adapters.
Figure 10:
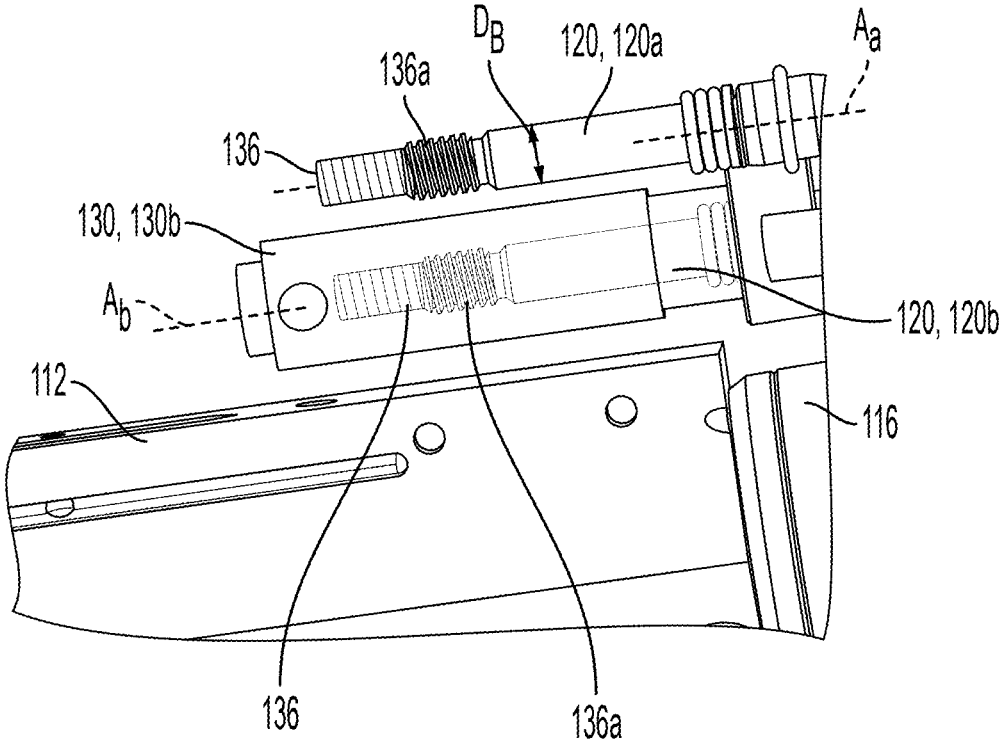
FIG. 10 is a side perspective view of the arrow gun of FIG. 2 with the barrel manifold removed showing the barrel adapters.
Figure 11:
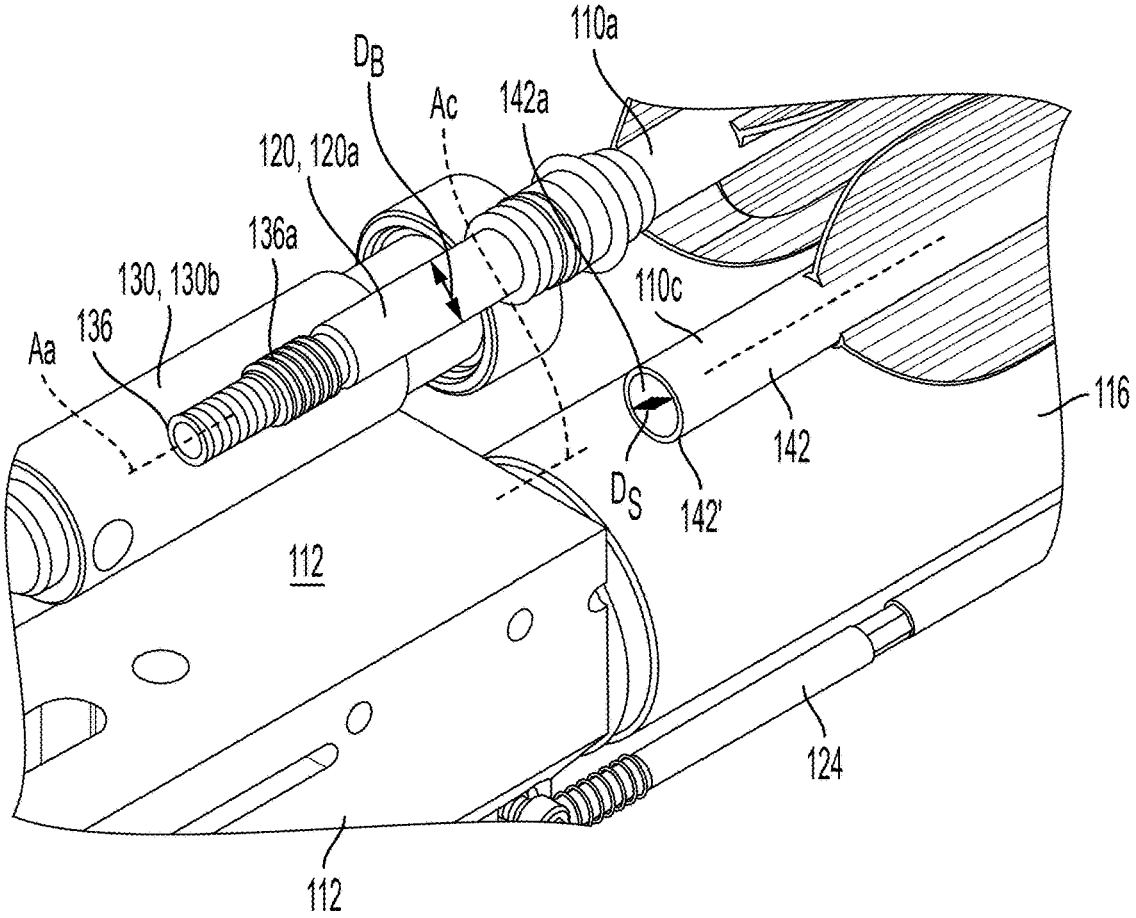
FIG. 11 is a rear perspective view of the arrow gun of FIG. 2 with the barrel manifold removed showing the barrel adapters.
Figure 12:
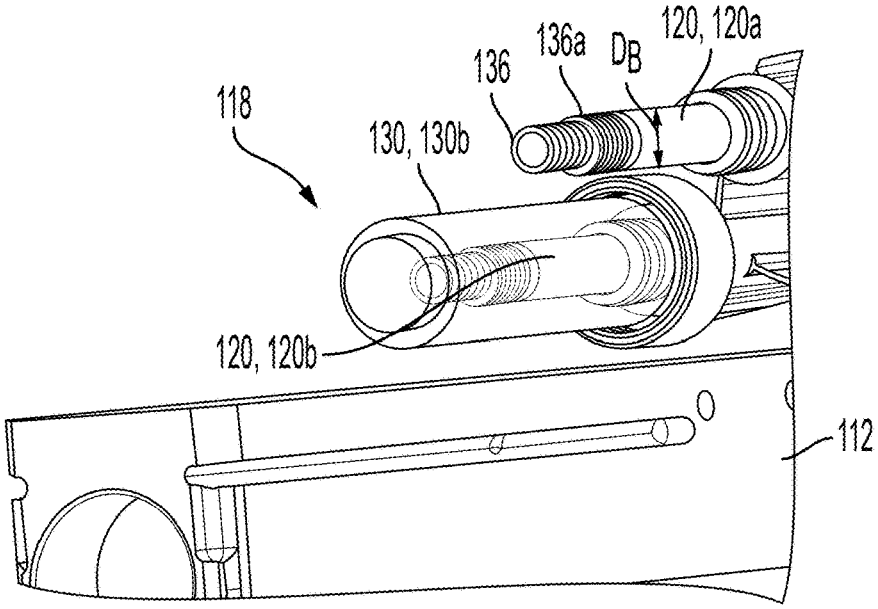
FIG. 12 is a rear perspective view of the arrow gun of FIG. 2 with the barrel manifold removed showing a barrel adapter in phantom.
Figure 13:
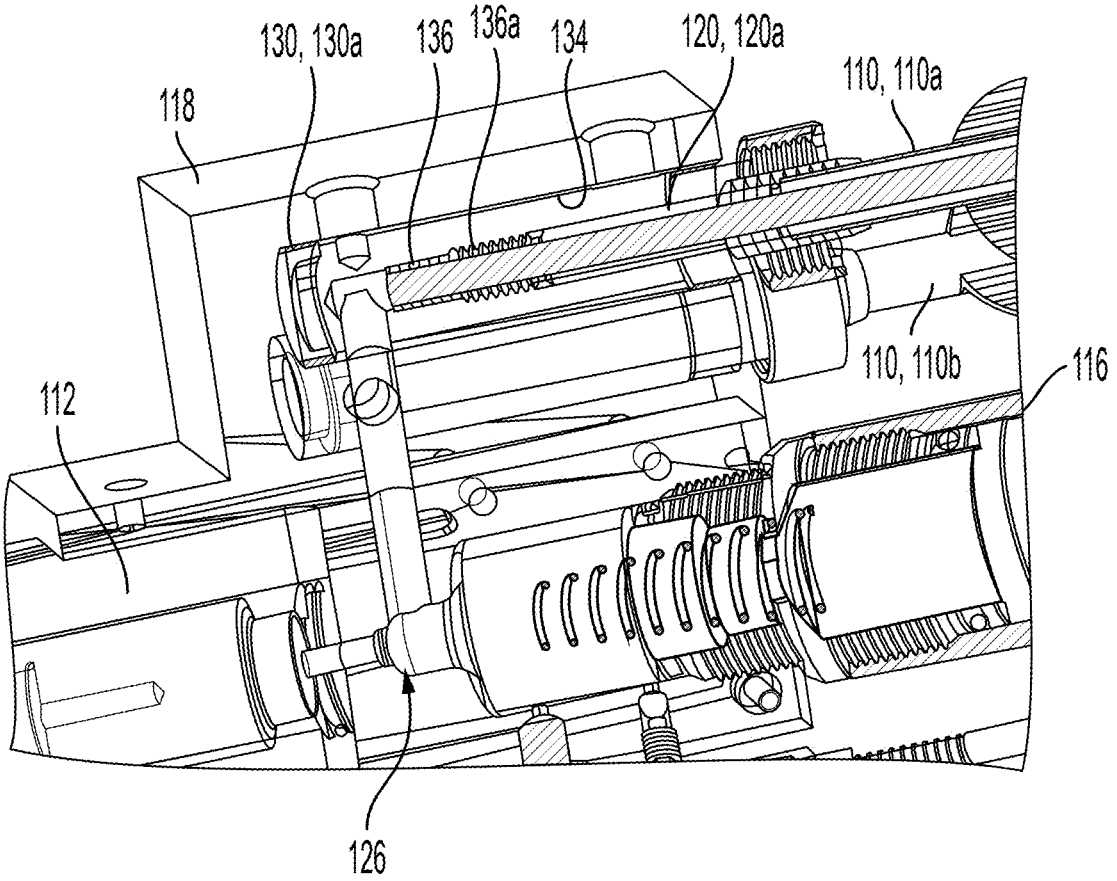
FIG. 13 is a cross sectional view of a portion of the arrow gun of FIG. 2.
Figure 14:
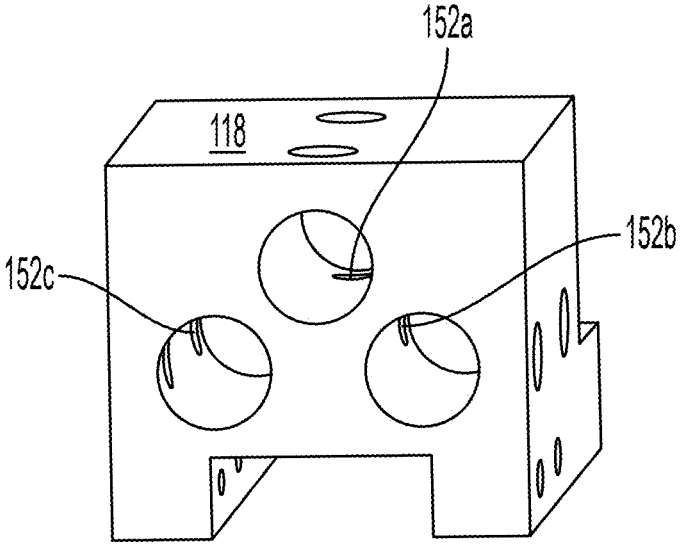
FIG. 14 is a front perspective view of the barrel manifold.
Figure 15:
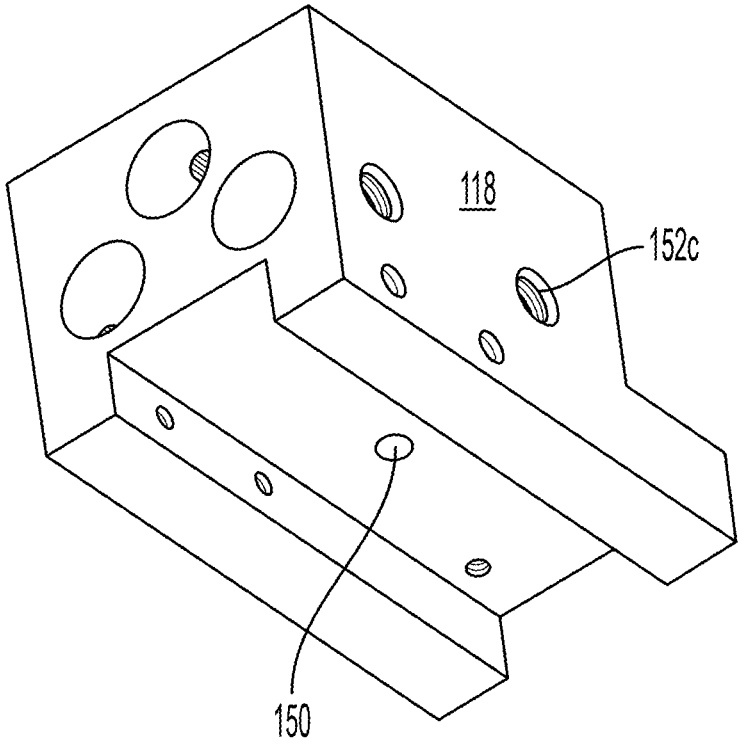
FIG. 15 is a bottom perspective view of the barrel manifold.
Figure 16:
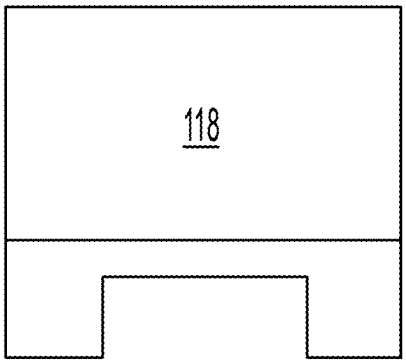
FIG. 16 is a rear elevational view of the barrel manifold.
Figure 17:
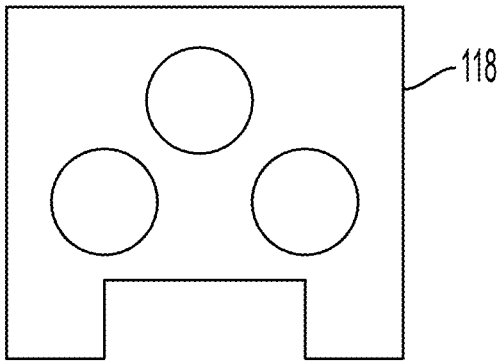
FIG. 17 is a front elevational view of the barrel manifold.

As seen in FIGS. 2-4, the arrow gun 100 includes at least two elongate barrels 120*a*, 120*b*, and in some configurations, three 120*c*, or more barrels 120. For purposes of description, the arrow gun 100 is described as having three barrels 120*a*, 120*b*, 120*c*, however it is understood the present disclosure can be applied to arrow guns have two, three, four, or more barrels. As set forth below, each arrow 110 releasably engages the corresponding barrel 120, wherein a certain pressure of compressed gas in the barrel 120 is required to launch the arrow 110. This pressure level of compressed gas is referred to as a minimum thrust pressure or launching pressure. Specifically, as compressed gas from the high pressure reservoir 116 is initially exposed to the barrel 120 and the engaged arrow 110, the pressure begins to increase. However, during a portion of the pressure increase, the arrow 110 remains engaged with the barrel 120. The arrow 110 then begins moving relative to the barrel 120 in response to the compressed gas exerting the launching pressure on the arrow 110.

In one configuration, a flow path includes the firing valve intermediate the high pressure reservoir 116 and the barrel manifold 120, and the regulator 128 intermediate the high pressure reservoir 116 and the firing valve. The regulator 128 is configured to receive a high pressure gas from the upstream high pressure reservoir 116 and pass a regulated pressure gas to the downstream firing valve.

The regulator 128 has an inlet to receive the motive gas from the high pressure reservoir through the second port. The regulator drops the pressure of the motive gas from the pressure of the high pressure reservoir to a regulated gas pressure. In one configuration, the regulated gas pressure is approximately 225 psi.

The regulator 128 can be a single or multi-stage regulator. In a two-stage regulator the regulator drops the motive gas from the pressure of the high pressure reservoir to approximately 700 psi to 800 psi in the first stage and then drops the pressure to a firing pressure at the regulated pressure of approximately 225 psi to be exposed to the barrels. It is understood these pressures are not limiting to the present system, but are rather illustrative. The regulator 128 can be any commercially available single or multi-stage regulator.

The regulator 128 has an outlet for establishing the motive gas at the regulated pressure to the firing valve. The firing valve then selectively exposes the regulated pressure gas to the barrels 120 through the respective flow paths.

Thus, the flow path extends from the high pressure reservoir 116, through the firing valve to the respective barrel 120*a*, 120*b*, 120*c*. As set forth below, the respective flow path 132*a*, 132*b*, 132*c* to at least one of the barrels 120*a*, 120*b*, 120*c* includes a differentiating section or length. As set forth below, the differentiating section can be configured as a unique length or the section of the flow path, a differing cross section of a portion the flow path, a different property of the material of the differentiating section, such as elasticity, or a different effective length, or any combination thereof.

Alternatively, it is contemplated a sequencing valve can be located in the flow path intermediate the high pressure reservoir 116 and the respective barrel 120*a*, 120*b*, 120*c*, wherein the sequencing valve passes the pressurized gas, regulated or unregulated to the respective flow path to each barrel 120*a*, 120*b*, 120*c*. That is, the sequencing valve can operate in conjunction with identical downstream flow paths to each barrel, thereby differentiating the arrival of the minimum thrust pressure between the barrels.

Generally, the flow paths are configured so that simultaneously exposing an upstream portion of the respective flow paths 132*a*, 132*b*, 132*c* to the pressurized mass of high pressure gas (which may or may not be regulated), the minimum thrust (launching) pressure is achieved at different times in the different barrels 120*a*, 120*b*, 120*c*. It is further contemplated the flow paths 132*a*, 132*b*, 132*c* can be configured so that the minimum thrust (launching) pressure is effectively simultaneously received at each barrel 120*a*, 120*b*, 120*c*. That is, the flow paths 132*a*, 132*b*, 132*c* can be configured such that the arrows 110*a*, 110*b*, 110*c* will launch at what a user will perceive to be substantially simultaneously, or the arrows 110*a*, 110*b*, 110*c* will launch within an overlapping distance, (as the arrows in flight would have a common longitudinal position), or the arrows 110*a*, 110*b*, 110*c* would be launched as longitudinally separated or gapped, see e.g., FIG. 29. In embodiments, the configuration of or spacing of the first, second, and third barrels 120*a*, 120*b*, 120*c* can be configured in a pattern intended to cause a desired impact pattern at a target, see e.g., FIG. 30.

It is believed a benefit of launching the arrows at slightly different times, or sequentially, or offset is that the fletching 146*a*, 146*b*, 146*c* of each arrow 110*a*, 110*b*, 110*c* is not impended by fletching 146*a*, 146*b*, 146*c* of another arrow 110*a*, 110*b*, 110*c*, see e.g., FIGS. 4 and 29. As set forth above, it is contemplated the flow paths 132*a*, 132*b*, 132*c* can be configured such that though the flow paths are concurrently exposed to a rise in pressure from the compressed gas passing from the high pressure reservoir 116 (such as through the firing valve), the flow paths 132*a*, 132*b*, 132*c* are configured such that the minimum thrust (launching) pressure of the compressed gas is achieved at different times for each of the barrels 120*a*, 120*b*, 120*c*, thereby causing a staggered or sequential launching of the respective arrows 110*a*, 110*b*, 110*c*.

It is further contemplated different flow path lengths can be provided by the seating of the arrow 110*a*, 110*b*, 110*c* on the respective barrel 120*a*, 120*b*, 120*c* being at different longitudinal positions along the longitudinal dimension of the gun, see FIG. 4. Or alternatively, the lengths of the barrels 120*a*, 120*b*, 120*c* may be different, thus imparting launching pressure at different times. However, it is recognized this would result in the launched arrows having different energies, and thus different flight paths and different target impact.

In one configuration, there is a flow path fluidly connecting the high pressure reservoir to each barrel and hence the hollow portion of an arrow operably engaged with a corresponding barrel. That is, a first flow path extends from the high pressure reservoir to the first barrel and a second flow path extends from the high pressure reservoir to the second barrel, and in further configurations a third flow path extends from the high pressure reservoir to a third barrel. As set forth below, at least one of the first flow path, the second flow path, and the third flow path has a differentiating section, such as a unique length or segment that is different from another one other flow paths, thereby providing the sequential firing pressure at the barrels (as the minimum thrust pressure is achieved at different times at the different barrels). The unique length of the flow path can include different nonlinear lengths, different absolute lengths, different cross sectional profiles, as well as partial occlusions, such as a screen or filter, or throat, or constriction.

It is further understood the respective flow paths can include a common length or section. That is, a length in all the flow paths is defined by a common single path, wherein the common single path then splits or branches into the unique length of each flow path.

The unique lengths of the flow paths are configured such that upon introduction of a mass of pressurized/compressed gas into a common section of the first, second, and third flow paths, the minimum thrust pressure of the compressed gas reaches the respective barrel at different times, thereby causing corresponding arrows to launch sequentially or at different times.

It is further contemplated there can be a corresponding plurality of separate flow paths from the high pressure reservoir, or the valve to the respective barrel (and hence hollow portion of a corresponding engaged arrow), wherein each flow path has a unique flow resistance configured to provide a launching pressure of the compressed gas to the respective hollow portion at different times from a common release of the compressed gas from the valve.

For example, the flow paths may have unique nonlinear segments of lengths, unique throats or constrictions in flow paths, or different lengths, or any combination thereof which form the differentiating section configured to impart a sequential delivery of the firing pressure of compressed gas to the respective/corresponding barrel (and hence hollow portion of the arrow). As set forth below, differentiating section can also be configured as a length of air tube.

Referring to FIGS. 13-24, in one configuration, the barrels 120*a*, 120*b*, 120*c* are connected to and extend from the barrel manifold 118. The barrel manifold 118 includes an inlet 150 and at least a first and a second outlet 152*a*, 152*b*, and as shown in FIGS. 21 and 23, a third outlet 152*c*. The barrel manifold 118 includes the barrel adapter 130*a*, 130*b*, 130*c* for operably retaining each barrel 120*a*, 120*b*, 120*c* relative to the barrel manifold 118. The barrel adapter 118 can be as set forth in U.S. Pat. No. 11,378,353, herein expressly incorporated by reference. Further, the coupling can include the barrel adapter and damping coupling as set forth in U.S. Pat. No. 11,378,353.

Thus, an elongate first barrel 120*a* is connected to the first outlet 152*a* of the barrel manifold 118 and extends along a first longitudinal axis to terminate at a first free end, the first barrel 120*a* has an outer diameter sized to be slidably received within the first hollow portion 142*a* of the first arrow 110*a*; an elongate second barrel 120*b* is connected to the second outlet 152*b* of the barrel manifold 118 and extends along a second longitudinal axis to terminate a second free end, the second barrel 120*b* having an outer diameter sized to be slidably received within the second hollow portion 142*b* of the second arrow 110*b*; and an elongate third barrel 120*c* is connected to the third outlet 152*c* of the barrel manifold 118 and extends along a third longitudinal axis to terminate a third free end, the third barrel 120*c* having an outer diameter sized to be slidably received within the third hollow portion 142*c* of the third arrow 110*c*.

Referring to FIGS. 13, 15, 18-21, and 23-25, the barrel manifold 118 includes a first manifold passageway 154*a* from the inlet 150 to the first outlet 152*a*, a second manifold passageway 154*b* from the inlet 150 to the second outlet 152*b*, and a third manifold passageway 154*c* from the inlet 150 to the third outlet 154*c*, wherein the first, second, and third manifold passageways 154*a*, 154*b*, 154*c* are configured to incorporate the differentiating section to impart the sequential delivery of the minimum thrust pressure of the compressed gas between at least two of the respective outlets 152*a*, 152*b*, 152*c*. It is contemplated each of the flow paths can include a differentiating section, thereby providing sequential launching pressure across all barrels.

In one configuration, the flow path to a given barrel includes the corresponding manifold passageway in the barrel manifold, thereby providing the differentiating section as a unique flow path to each barrel. It is understood the flow path to each barrel can include the common length or section with the other flow paths between the high pressure reservoir and the barrel manifold or between the high pressure reservoir and the valve, wherein the respective differentiating or unique section is provided by the barrel manifold.

Referring to FIGS. 4, 21 and 23, it is also contemplated the second and third barrels 120*b*, 120*c* can be disposed at a common elevation and are laterally spaced further apart than to the first barrel 120*a*, wherein the fletching 146*b*, 146*c* of the arrows 110*b*, 110*c* on the second and third barrels would not interfere in simultaneous flight, the second and third flow paths 132*b*, 132*c* are configurated such that the launching pressure is reached simultaneously but sequential to the minimum thrust pressure at the first barrel 110*a*. The flow of compressed gas through the first manifold passageway from the inlet of the barrel manifold to the first barrel passes is a straight path. In contrast, the flow of compressed gas through the second and third manifold passageway from the inlet of the barrel manifold to the respective second and third barrel passes through a change in flow direction, and specifically a right-angle change in flow direction. This turning of the flow in the manifold passageways slows the passing flow of gas, as well as removing some energy from the flow, and thus relatively delays the minimum thrust pressure at the second and third barrels. In this configuration, the first barrel 120*a* achieves the minimum thrust pressure before the second and third barrels 120*b*, 120*c*, wherein the second and third barrels can achieve the minimum thrust pressure substantially simultaneously.

It is further contemplated the spacing of one of the second and third barrels can be asymmetrically located relative to the inlet of the barrel manifold, thereby differentiating the second manifold passageway from the third manifold passageway. In this configuration, each of the three arrows achieves the minimum thrust pressure at a unique time.

In embodiments, the differentiating section can be imparted by the manifold having a first set of passageways with a first firing sequence and a second set of passageways with a second firing sequence, wherein the manifold is movable between a first position that fluidly connects the first set of passageways to the barrels and a second position that fluidly connects the second set of passageways to the barrels. In one embodiment of this type, a user can select which of the first firing sequence and the second firing sequence is used, such as by way of a manually operated mechanism, an electrical, an electromechanical, or pneumatic actuator.

In another embodiment of this type, the manifold may have sufficient mass so that when the airgun is moved along or rotated about a predetermined axis with a predetermined acceleration, the manifold remains stationary relative to other components of the airgun so as to present the first set of passageways to the barrels when the airgun is moved along the predetermined axis in a first direction and to present the second set of passageways to the barrels when the airgun is moved along the predetermined axis in a second direction, thereby selectively changing the differentiating section of the respective flow paths.

In a further configuration, a throttle is disposed in at least one of the flow paths, wherein the throttle is configured to selectively impart the differentiating section, such as by imparting a first restriction pattern to the first flow path. It is contemplated that each of the flow paths can include a throttle or a portion of a throttle, wherein depending upon the position of the throttle, the throttle imparts a restriction to each of the flow paths, wherein the imparted restrictions can render the respective flow path unique. That is, the imparted restriction can be the same for at least two or for all of the flow paths, or the restriction can be different for at least one of the flow paths or among each of the flow paths (that is the throttle can impart a unique restriction to each of the flow paths.

In one configuration, the throttle is located to impart the restriction in the manifold passageways. However, it is understood the throttle can be operably located along a flow path impart a restriction to a barrel associated with the flow path.

Referring to FIGS. 32-35, the throttle 160 can include a throttle body 162 movable between a first position and a second position to selectively impart the restriction to the respective flow path 132. The restriction in the flow path can be imparted by aligning a transfer port 164 of the throttle body 162 with the respective flow path 132, wherein the transfer port 164 has a smaller cross sectional area than the respective flow path or the transfer port 164 in conjunction with a portion of the periphery of the flow path imparts the restriction. Thus, the throttle body 162 can include at least one transfer port 164, wherein the transfer port 164 defines an aperture or an occluding portion for occluding a portion of the respective flow path 132.

Depending on the design implementation, the throttle body 162 can move transverse to the longitudinal axis, parallel to the longitudinal axis, or inclined relative to the longitudinal axis.

It is further contemplated that the throttle body 162 can be a wheel or rotatable member such as a disk or partial disk, a cam, or a pivoting member that be selectively disposed between a first position and a second position to selectively impart the restriction in the respective flow path.

In one configuration, the throttle body 162 can include a throttle plate 166 having a plurality of apertures 168 defining the restriction for the flow paths 132. That is, the cross sectional area of the apertures can impart the respective restrictions to the respective flow path. Although the throttle plate 166 is shown with apertures, it is understood the restrictions can be imparted by the throttle plate having an occluding portion such as a scalloped edge which is selectively disposed within the flow path, thereby partly occluding and providing the restriction in the flow path.

As seen in FIGS. 33-35, the apertures 168 in the throttle plate 166 can have different cross sectional areas. The apertures 168 can be sized to provide no restriction of the flow path 132 when aligned with the flow path to occluding 99% of the flow path. Further, the apertures 168 can be aligned such that different restriction patterns can be concurrently imparted to a plurality of flow paths 132, such as the three flow paths 132*a*, 132*b*, 132*c* shown in the FIGS. For example, the throttle body 162 can include five colinearly aligned apertures 168*a*, 168*b*, 168*c*, 168*d*, 168*e*, wherein the middle three apertures 168*b*, 168*c*, 168*d* have the same cross sectional area (sized not to occlude the respective flow path 132*a*, 132*b*, 132*c*, and the outside apertures, the first and the fifth aperture 168*a*, 168*e*, have a smaller cross sectional area than the aligned flow path to impart a restriction of flow through the respective flow path 132*a*, 132*b*, 132*c*. It is understood any of a variety of patterns of cross sectional areas of the aperture can be employed, depending on the intended restriction as well the configuration of the specific transfer ports of the throttle body.

For example, referring to FIGS. 33-35, the throttle body 162 moves transverse to the longitudinal axis of the barrel 120, and cooperates with three separate flow paths 132*a*, 132*b*, 132*c*, each flow path passing to a given barrel. The throttle body 162 includes five colinear apertures 168*a*, 168*b*, 168*c*, 168*d*, 168*e*, wherein a first subset 168' of three apertures 168*a*, 168*b*, 168*c* is spaced to align with the three flow paths 132*a*, 132*b*, 132*c* in at least a first position of the throttle body 162 and a second subset 198" of apertures 168*c*, 168*d*, 168*e* is spaced to align with the three flow paths 132*a*, 132*b*, 132*c* in the second position of the throttle body 162.

In one configuration, each of the flow paths 132*a*, 132*b*, 132*c* have equal cross sectional areas at the interface with the throttle body 162. In one configuration, the aperture 168*c* has the same cross sectional area of the flow paths. The apertures 168*a*, 168*e* are the smallest apertures, and the intermediate apertures 168*b*, 168*d* have a cross sectional area greater than apertures 168*a*, 168*e* and smaller than aperture 168*c*.

In operation, when the throttle body 162 is centrally disposed relative to the barrel, the non-restrictive aperture 168*c* is aligned with the second or center barrel 120*b*, aperture 168*b* is aligned with the first or left barrel 120*a*, and aperture 168*d* is aligned with the third or right barrel 120*c*. As apertures 168*b*, 168*d* are of smaller cross sectional area than the aperture 168*c*, greater restriction is imparted to the first and third barrels 120*a*, 120*c*. Thus, upon the pressurized gas passing along the respective flow paths, aperture 168*c* first passes the minimum thrust pressure (launch pressure) to the second barrel 120*b* and the corresponding arrow 110*b* is launched. Apertures 168*b*, 168*d*, restricting the corresponding flow paths relative to aperture 168*c* cause a delay in the minimum thrust pressure (launch pressure) being achieved at the first and the third barrels 120*a*, 120*c*. Thus, the arrows 110*a*, 110*c* of the first and the third barrel launch after the arrow 110*b* on the second barrel.

Referring to FIG. 33, when the throttle body 162 is moved to the furthest right (relative to the barrel) position, aperture 168*a* (the smallest aligned aperture) aligns with the first (left) barrel 120*a*, aperture 168*b* (the intermediate size aligned aperture) with the second (middle) barrel 120*b*, aperture 168*c* (the largest aligned aperture) with the third (right) barrel 120*c*, and apertures 168*d*, 168*e* are not aligned with any flow path. Thus, upon the pressurized gas passing along the flow paths to the throttle 160, the minimum thrust pressure (launch pressure) first passes through the aperture 168*c* of the throttle body and to the aligned third (right) barrel 120*c*, thereby first launching the arrow 110*c* from the third (right) barrel 120*c*. The next largest aligned aperture, aperture 168*b*, passes the minimum thrust pressure (launch pressure) to the aligned second (center) barrel 120*b*, thereby next launching the arrow 110*b* from the second (center) barrel 120*b*. Aperture 168*a* (the smallest aligned aperture) aligned with the first (left) barrel 120*a* thus delays the minimum thrust pressure (launch pressure) at the first (left) barrel 120*a* until after the minimum thrust pressure (launch pressure) has been achieved at the third barrel 120*c* and the second barrel 120*b*. Thus, in this position of the throttle body 162, the throttle body 162 provides sequential launching of arrows 110*c*, 110*b*, 110*a* from the third (right) barrel 120*c*, then the second (center) barrel 120*b*, then the first (left) barrel 120*a*.

Referring to FIG. 34, when the throttle body 162 is moved to the furthest left (relative to the barrel) position, apertures 168*a*, 168*b* are not aligned with any flow path, aperture 168*c* (the largest aperture) aligns with the first (left) barrel 120*a*, aperture 168*d* (the intermediate size aperture) with the second (middle) barrel 120*b*, and aperture 168*e* (the smallest aperture) aligns with the third (right) barrel 120*c*. Thus, upon the pressurized gas passing along the flow paths to the throttle 160, the minimum thrust pressure (launch pressure) passes first through the aperture 168*c* of the throttle body 162 and to the aligned first (left) barrel 120*a*, thereby first launching the arrow 110*a* from the first (left) barrel 120*a*. The next largest aligned aperture, aperture 168*d*, is aligned with the second (center) barrel 120*b* and passes the minimum thrust pressure (launch pressure) to the aligned second (center) barrel 120*b*, thereby next launching the arrow 110*b* from the second (center) barrel 120*b*. Aperture 168*e* (the smallest aligned aperture of the throttle body 162) is aligned with the third (right) barrel 120*c* and thus delays the minimum thrust pressure (launch pressure) at the third (right) barrel 120*c* until after the minimum thrust pressure (launch pressure) has been achieved at the first and the second barrels 120*a*, 120*b*. Thus, in this position of the throttle body 162, the throttle body 162 provides sequential launching of arrows 110*a*, 110*b*, 110*c*, first from the first (left) barrel 120*a*, then the second (center) barrel 120*b*, then the third (right) barrel 120*c*.

Referring to FIG. 35, when the throttle body 162 is centrally positioned relative to the barrel, the apertures 168*a*, 168*e* are not aligned with any flow path, aperture 168*b* (the same size as aperture 168*d*) aligns with the first (left) barrel 120*a*, aperture 168*c* (the larger aligned aperture) aligns with the second (center) barrel 120*b*, aperture 168*e* (the same size aperture as the aperture 168*b*) aligns with the third (right) barrel 120*c*. Thus, upon the pressurized gas passing along the flow paths to the throttle 160, aperture 168*d* of the throttle body 162 aligned with the second (center) barrel 120*b* first passes the minimum thrust pressure (launch pressure), thereby first launching the arrow 110*b* from the second (center) barrel 120*b*. The next largest aligned apertures, (apertures 168*b*, 168*d*), are aligned with the first (left) barrel 120*a* and the third (right) barrel 120*c* respectively, and pass the minimum thrust pressure (launch pressure) to the aligned first (left) barrel 120*a*, and the third (right) barrel 120*c*, thereby substantially simultaneously launching the arrows 110*a*, 110*b* from the first and third barrels 120*a*, 120*c*, respectively. Thus, in this position of the throttle body, the throttle body provides sequential launching of arrows, first from the second (center) barrel, then substantially simultaneously from the first (left) barrel and the third (right) barrel.

Referring to FIGS. 32-35, it is contemplated the throttle body 162 as the throttle plate 166 can be transversely movable relative to the longitudinal axis. Movement of the throttle body 162 can be provided by manual actuation, directly or indirectly, as well as mechanically, or pneumatically. For example, each end of the transverse throttle plate 166 can be weighted, wherein the weight is sufficient such that upon rotation of the barrel about the longitudinal axis in a first direction by at least 15 degrees from a horizontal orientation, the throttle plate moves from the first position to the second position. Similarly, by rotation of the barrel about the longitudinal axis in a second direction by at least 15 degrees, the throttle plate moves from one position to another position, such as from the second position to the first position.

The restrictions imparted to the flow paths can range from 0% to 99% of the original cross sectional area of the respective flow path, thereby providing the differentiating section of the respective flow path. As the cross sectional area of the circular cross section of the flow path increases as the square of the radius, relatively small changes in the effective radius of the flow path can impart greater changes in the available cross sectional area.

In a further configuration, the flow paths are configured to include the air tubes defining at least a portion of the length of the flow path, wherein the air tubes provide the differentiating section of the flow path. Thus, in one configuration, the air tubes can extend from the high pressure reservoir as individual flow paths or as portions of the flow path, wherein the flow paths include a common length or section. It is further contemplated the air tubes can define a portion or length of the flow path. That is, the air tubes can be from approximately 1% of the length of the flow path to over 90% of the length of the flow path. However, as set forth below the available control through the use of the air tubes may be achieved with air tubes being between 10% and 80% of the length of the flow path.

The air tubes can be formed a resilient or configurable material, such as but not limited to polymers. The air tubes can be configured to provide the different path lengths as set forth above, wherein the different path lengths provide the differentiating section. In addition, the air tubes can have specific cross sections including specific cross sectional areas, thereby providing control of the amount of pressurized gas that is able to pass to the respective barrel. As seen in FIG. 27, at least two of the air tubes can have different lengths, and as shown, two of the air tubes have the same length and the third air tube has a different length.

It is further contemplated the air tubes can be deformable, thus a restrictor or clamp can be applied to the air tube to reduce the available cross sectional air for flow, thereby regulating the timing of the minimum thrust pressure (launch pressure) at the respective barrel. Alternatively, or additionally, the air tubes may be deformable through an application of heat, wherein the cross section of at least a portion of the air tube can be heated and shaped to a given cross section, then cooled, wherein the air tube retains the deformed shape.

It is further contemplated that the air tubes can have a selected elasticity, such that upon exposure of the air tube to the gas pressure in the flow path, the section of air tube slightly expands, thereby effectively delaying the delivery of the minimum thrust pressure (launch pressure) to the respective barrel and setting the timing of the launch of the respective arrow. It is contemplated the elasticity of the air tube can be obtained through factors such as thickness of the wall, type of material, unsupported lengths of the air tube, as well as combination of these factors.

Thus, the differentiation of the flow paths from the high pressure reservoir or the intermediate regulator to the respective barrel can be provided by the use of the barrel manifold, the air tubes in the flow paths, or a combination of the barrel manifold and the air tubes in the flow paths, as well as the selective positioning of the throttle.

Referring to FIG. 28, the mounting of the barrels 120 (e.g., barrels 120*a*, 120*b*, 120*c*) in the throttle body 162 can be configured to provide adjustable alignment of the barrels 120 relative to each other and the throttle body 162. The throttle body 162 can include an adjustment mechanism 170 for selectively aligning the longitudinal axis of the respective barrels 120. The barrels 120 can be connected to the throttle body 162 through a resilient coupler 172, such as but not limited to a gasket. The resilient coupler 172 is configured to accommodate movement, such as a rotation of the barrel 120 generally perpendicular to the longitudinal axis.

One configuration of a barrel adjustment mechanism 170 is shown in FIG. 28. The throttle body 162 includes the three barrel mounts 130', wherein an adjusting channel 174 extends between adjacent barrel mounts 130'. The adjusting channel 174 can include a bias member 176, such as a spring which extends through the adjusting channel 174 between adjacent barrels 120. It is contemplated the bias members 176 balance the forces acting on the barrels 120, such that the longitudinal axis of the center barrel 120*b* remains constant while the longitudinal axis of the outside barrels 120*a*, 120*c* can be set in a converging, parallel or diverging relationship. As the adjustment mechanism 176 acts on a given barrel 120, the associated resilient coupler 172 is deformed to allow a change in the direction of the longitudinal axis.

However, it is understood the barrel adjustment mechanism can include a separate adjustment of each barrel, such as by independent actuators acting on the respective barrel and mount. For example, the actuators can be levers, cammed levers, or adjustable drivers which can act directly or indirectly on the respective barrel in the barrel mount to adjust the longitudinal axis of the respective barrel. In embodiments, where the manifold moves relative to other components of the airgun, a mechanism, such as a slide or soupler, can use the motion of the manifold to adjust the longitudinal axis of one or more of the barrels.

With reference to FIGS. 29-31, in one configuration, each barrel 120 is associated with a corresponding arrow rest 180 (e.g., a "whisker biscuit"), such as but not limited to that disclosed in U.S. Pat. No. 5,896,849 and RE38,096 each of which is hereby expressly incorporated by reference. The arrow rest 180 is located proximal to the front the arrow 110. In one configuration, the arrow rests 180 are translatable relative to the front of stock, such that a center of the arrow rest 180 remains concentric with the longitudinal axis of the respective barrel 120. However, it is contemplated, that depending on the amount of available adjustment of the barrels 120 that the arrow rest 180 can remain stationary, or fixed, without imparting a material bias on the arrow 110 as it travels along the length of the barrel 120.

Thus, the barrels 120 can be aligned such that the trajectory of the launched arrows 110 intersects at a given distance (see FIG. 30). That is, the longitudinal axis of the respective barrels 120 can be aligned so that the longitudinal axes intersect beyond the muzzle. Alternatively, the longitudinal axis of the respective barrels 120 can be aligned so that the axes diverge beyond the muzzle. While the adjustment within the throttle body 162 is shown as adjusting the longitudinal axis within a given plane, it is contemplated the adjustment can include a vertical inclination of the respective longitudinal axis relative to horizontal.

In operation, the high pressure gas from the high pressure reservoir acts on the inlet of the regulator through a portion of the flow path. As seen in the FIGS., this portion of the flow path is common to each of the barrels. The regulator passes a regulated gas pressure to the firing valve. Upon actuation of the firing valve, via the trigger, a mass of pressure regulated gas passes along the flow path downstream of the firing valve towards the barrel manifold, and then to each of the barrels.

In one configuration, as the mass of regulated pressure gas then passes along the common portion of the flow path, and the pressurized gas passes the inlet of the barrel manifold. The pressure front of the mass of regulated pressure gas passes directly upward to the first barrel through the first manifold passageway and begins pressurizing the first barrel. The pressure front of the mass of regulated pressure gas must change direction through the second and third manifold passageways and progress towards the second and third barrels. As the pressure front is forced to change direction in the second and third manifold passageways, the pressure is slightly reduced (as compared to the pressurized gas in the first manifold passageway) and hence the time to achieve the minimum thrust pressure (launching pressure) at the second and third barrels is increased. This delay provides the launching pressure at the first barrel prior to the launching pressure in the second and third barrels. As the second barrel and third barrels are spaced by a greater distance than the first and second barrel or the first barrel and the third barrel, the first arrow is launched prior to the second or third arrow from a common mass of regulated gas pressure passing the firing valve.

Alternatively, when the pressure front of the mass of regulated pressure gas passes to the air tubes, the differentiating section defined by the air tubes causes the minimum thrust pressure (launching pressure) to be sequentially achieved at the barrels, thereby sequentially launching the corresponding arrows.

In a further configuration, when the pressure front of the mass of regulated pressure gas passes to the throttle, the throttle imparts the differentiating section and causes the sequential delivery of the minimum thrust pressure (launching pressure) to the barrels, thereby sequentially launching the corresponding arrows.

While the invention has been described in connection with several presently preferred embodiments thereof, those skilled in the art will appreciate that many modifications and changes may be made without departing from the true spirit and scope of the invention which accordingly is intended to be defined solely by the appended claims.

What is claimed is:

1. An arrow gun using compressed gas to propel a first arrow having a first hollow portion and a second arrow having a second hollow portion, the arrow gun comprising:

(a) a high pressure reservoir configured to retain a mass of pressurized gas;

(b) an elongate first barrel extending along a first longitudinal axis to terminate a first free end, the first barrel having an outer diameter configured to be slidably received within the first hollow portion of the first arrow;

(c) a first flow path fluidly connecting the high pressure reservoir and the first barrel;

(d) an elongate second barrel connected to the second outlet and extending along a second longitudinal axis to terminate a second free end, the second barrel having an outer diameter sized to be slidably received within the second hollow portion of the second arrow; and (e) a second flow path fluidly connecting the high pressure reservoir and the second barrel, wherein the first flow path and the second flow path are configured to sequentially expose the first barrel and the second barrel to a minimum thrust pressure in response to a release of a portion of the mass of pressurized gas from the high pressure reservoir.

2. The arrow gun of claim 1, wherein the first flow path and the second flow path include a common length.

3. The arrow gun of claim 2, further comprising a barrel manifold including an inlet, a first outlet, and a second outlet, the barrel manifold having a first manifold passageway from the inlet to the first outlet and a second manifold passageway from the inlet to the second outlet.

4. The arrow gun of claim 3, wherein one of the first manifold passageway and the second manifold passageway includes a constriction.

5. The arrow gun of claim 1, further comprising a valve having an inlet and an outlet, the inlet fluidly connected to the high pressure reservoir and the valve configured to selectively pass the pressurized gas to the outlet.

6. The arrow gun of claim 1, wherein one of the first flow path and the second flow path includes a differentiating section.

7. The arrow gun of claim 3, further comprising a valve in the flow path intermediate the high pressure reservoir and the inlet of the barrel manifold.

8. The arrow gun of claim 5, further comprising a third flow path fluidly connecting the outlet of the valve and the second barrel.

9. The arrow gun of claim 6, wherein at least one of the second flow path and the third flow path includes a differentiating section, the differentiating section configured to sequentially generate a minimum thrust pressure at the first barrel and the second barrel.

10. The arrow gun of claim 1, further comprising a throttle moveable between a first position and a second position, wherein in one of the first position and the second position the throttle imparts a restriction to one of the first flow path and the second flow path, the restriction sufficient to provide a sequential launching of the first arrow and the second arrow.

11. The arrow gun of claim 10, further comprising a barrel manifold, wherein the barrel manifold defines a first portion of the first flow path and a second portion of the second flow path, and the throttle moves relative to the barrel manifold.

12. An arrow gun comprising:

(a) a high pressure reservoir configured to retain a mass of pressurized gas;

(b) an elongate first barrel fluidly connected to the high pressure reservoir, the first barrel extending along a first longitudinal axis to terminate a first free end, the first barrel having an outer diameter configured to be slidably received within a first hollow portion of a first arrow;

(c) an elongate second barrel fluidly connected to the high pressure reservoir, the second barrel extending along a second longitudinal axis to terminate a second free end, the second barrel having an outer diameter sized to be slidably received within a second hollow portion of a second arrow; and (d) a differentiating section fluidly intermediate the high pressure reservoir and at least one of the first elongate barrel and the second elongate barrel, the differentiating section configured to sequentially present a minimum thrust pressure to the first elongate barrel and the minimum thrust pressure at the second elongate barrel.

13. The arrow gun of claim 12, further comprising a barrel manifold having an inlet, a first outlet, and a second outlet.

14. The arrow gun of claim 13, further comprising a flow path fluidly connecting the high pressure reservoir and to the inlet and a valve in the flow path intermediate the high pressure reservoir and the inlet.

15. The arrow gun of claim 13, wherein the barrel manifold includes a first passageway connecting the inlet to the first outlet and a second passageway connecting the inlet to the second outlet.

16. The arrow gun of claim 15, wherein the first passageway has a first length from the inlet to the first outlet and the second passageway has a second length from the inlet to the second outlet, wherein the first length is different from the second length.

17. The arrow gun of claim 15, wherein the first passageway has a first length from the inlet to the first outlet and the second passageway has a second length from the inlet to the second outlet, wherein the first length has different cross section than the second length.

* * * * *